US005252438A

United States Patent [19]

Nii et al.

[11] Patent Number: 5,252,438

[45] Date of Patent: Oct. 12, 1993

[54] SILVER HALIDE PHOTOGRAPHIC MATERIALS

[75] Inventors: Kazumi Nii; Hisashi Okamura; Kazunobu Katoh, all of Kanagawa, Japan

[73] Assignee: Fuji Photo Film Co., Ltd., Kanagawa, Japan

[21] Appl. No.: 763,688

[22] Filed: Sep. 23, 1991

[30] Foreign Application Priority Data

Sep. 28, 1990 [JP] Japan ..... 2-258928

[51] Int. Cl.[5] ..... G03C 1/06; G03C 1/42

[52] U.S. Cl. ..... 430/264; 430/223; 430/544; 430/957

[58] Field of Search ..... 430/223, 264, 957, 544, 430/564

[56] References Cited

U.S. PATENT DOCUMENTS

| | | | |
|---|---|---|---|
| 4,684,604 | 8/1987 | Harder | 430/223 |
| 4,698,297 | 10/1987 | Ichijima et al. | 430/544 |
| 4,770,982 | 9/1988 | Ichijima et al. | 430/223 |
| 5,085,971 | 2/1992 | Katoh et al. | 430/544 |
| 5,132,201 | 7/1992 | Yagihara et al. | 430/264 |
| 5,134,055 | 7/1992 | Okamura et al. | 430/264 |

FOREIGN PATENT DOCUMENTS

| | | |
|---|---|---|
| 0393720 | 10/1990 | European Pat. Off. . |
| 0395069 | 10/1990 | European Pat. Off. . |

OTHER PUBLICATIONS

"An Improved Process for Hydrazine-Promoted Infectious Development of Silver Halide", by Kitchin et al., The Journal of Photographic Science, vol. 35, No. 5, (1987) pp. 162-164.

*Primary Examiner*—Richard L. Schilling
*Attorney, Agent, or Firm*—Sughrue, Mion, Zinn, Macpeak & Seas

[57] ABSTRACT

Disclosed is a silver halide photographic material containing a compound of a general formula (1) or (2):

$$\text{ED-(Time)}_t\text{-Y-L-Z} \quad (1)$$

wherein ED represents a group that releases the moiety $(\text{Time})_t$-Y-L-Z by reaction with an oxidation product of a developing agent; Time represents a divalent linking group; t represents 0 or 1; Y represents a divalent group comprising a hetero atom through which Y bonds to the moiety ED-$(\text{Time})_t$; L represents a divalent group which is capable of being cleaved by reaction with components in a developer; and Z represents a monovalent functional group that expresses a development inhibiting effect;

$$R_1-\underset{\underset{A_1}{|}}{N}-\underset{\underset{A_2}{|}}{N}-G_1-(\text{Time})_t-Y-L-Z \quad (2)$$

wherein Time, t, L and Z have the same meanings as above; Y represents a divalent group comprising a hetero atom through which Y bonds to the moiety $$R_1-\underset{\underset{A_1}{|}}{N}-\underset{\underset{A_2}{|}}{N}-G_1-(\text{Time})_t;$$

$R_1$ represents an aliphatic group or an aromatic group; $G_1$ represents is $$-\overset{O}{\overset{\|}{C}}-,\ -\overset{O}{\overset{\|}{C}}-\overset{O}{\overset{\|}{C}}-,\ -\overset{S}{\overset{\|}{C}}-,\ -\overset{N-G_2-R_2}{\overset{\|}{C}}-,\ -\overset{O}{\overset{\|}{\underset{\underset{G_2-R_2}{|}}{P}}}-;$$

$G_2$ represents a mere bond, —O—, —S— or $$-\underset{\underset{R_2}{|}}{N}-;$$

$R_2$ has the same meaning as $R_1$ or represents a hydrogen atom; when the compound has plural $R_2$'s, they may be same as or different from each other; and one of $A_1$ and $A_2$ represents a hydrogen atom, and the other repre- (Abstract continued on next page.)

sents a hydrogen atom, or an acyl group, an alkylsulfonyl group or an arylsulfonyl group.

The material may reproduce excellently a line original to form an ultra-hard image having a high background density. It also has a broad exposure latitude in halftone dot image-taking work and can form an ultra-hard halftone dot image with a high image quality. The material is useful in formation of ultra-hard negative images by photomechanical process.

11 Claims, 1 Drawing Sheet

SILVER HALIDE PHOTOGRAPHIC MATERIALS

FIELD OF THE INVENTION

The present invention relates to silver halide photographic materials and a method for forming an ultra-hard negative image with the materials. More specifically, it relates to ultra-hard negative photographic materials of high sensitivity which can be used in a photomechanical process for forming hard negative images.

BACKGROUND OF THE INVENTION

In the field of photomechanical process technology, photographic materials with excellent original-producibility, stable processing solutions and a simplified replenishment system are required for dealing with diversified and complicated print forms currently in use.

Originals employed in a line work process often are composed of phototypeset letters, hand-written letters, illustrations and halftone dot image photographs. Accordingly, the original contains plural images differing concentration and differing line width in combination. Photomechanical cameras and photographic materials capable of finishing the images from such originals with good reproducibility, as well as image-forming methods applicable to such photographic materials are desired earnestly. On the other hand, for the photomechanical process of producing catalogs or large-sized posters, blow-up or reduction of dot image photographs is effected widely. In the photomechanical process of using enlarged dot images, the dots are coarsened to give blurred photoprints. As opposed to this, in the photomechanical process for forming reduced photoprints, fine dots with an enlarged ratio of lines/inch are photographed. Accordingly, an image-forming method with much broader latitude is desired for the purpose of maintaining the reproducibility of halftone dot images in the photomechanical process.

As the light source for a photomechanical camera, a halogen lamp or xenon lamp is employed. To obtain sufficient photographing sensitivity to the light source, the photographic material employed in the photomechanical process is generally ortho-sensitized. However, it was found that ortho-sensitized photographic materials are influenced greatly by the chromatic aberration of a lens and therefore the quality of the images frequently is worsened by such an influence. It was further found that the deterioration of image quality is more noticeable when a xenon lamp is used as the light source.

As a system of attempting to satisfy the demand for broad latitude, a method is known where a lith-type silver halide photographic material composed of silver chlorobromide (having a silver chloride content of at least 50% or more) is processed with a hydroquinone-containing developer where the effective concentration of the sulfite ion therein is lowered extremely (generally, to 0.1 mol/liter or less) to obtain thereby a line image or halftone dot image having a high contrast and a high blackened density where the image portions and the non-image portions are clearly differentiated from each other. However, the method has various drawbacks. Precisely, since the sulfite concentration in the developer is low, development is extremely unstable to air oxidation. For the purpose of stabilizing the activity of the processing solution, various means are effected.

The processing speed is extremely slow and the working efficiency is poor.

Accordingly, an improved image-forming system is desired which is free from the instability of the image formation in the above-mentioned development method (lith-development system) and which may be processed with a processing solution having an excellent storage stability to give photographic images having ultra-hard photographic characteristics. As one example, a system of forming an ultra-hard negative image having a gamma value of more than 10 has been proposed, for example, in U.S. Pat. Nos. 4,166,742, 4,168,977, 4,221,857, 4,224,401, 4,243,739, 4,272,606 and 4,311,781, where a surface latent image-type silver halide photographic material containing a particular acryl hydrazine compound is processed with a developer which has an excellent storage stability and which contains a sulfite preservative in an amount of 0.15 mol/liter or more, under the condition of a pH value of from 11.0 to 12.3. The proposed image-forming system has the characteristic aspect that a silver iodobromide or silver chloroiodobromide-containing photographic material can be processed, although only a high silver chloride content-having silver chlorobromide photographic material can be processed by the conventional ultra-hard image-forming method.

The proposed image-forming system is excellent in that an image with a sharp halftone dot image quality is formed, the process proceeds stably at a high speed and the reproducibility of the original used is good. However, a further improved system with a further elevated original reproducibility is desired still for the purpose of satisfactorily dealing with the diversified print forms currently in use.

JP-A-61-213847 (the term "JP-A" as used herein means an "unexamined published Japanese patent application") and U.S. Pat. No. 4,684,604 disclose photographic materials containing a redox compound capable of releasing a development inhibitor by oxidation in an attempt at broadening the latitude of reproduction of gradation of images. However, where such a redox compound is added to a photographic material to be processed in an ultra-hard processing system using a hydrazine derivative in an amount sufficient for satisfactorily improving the reproducibility of reproducing both line images and halftone images, a part of the development inhibitor released from the redox compound would flow into the processing solution for development. As a result, when a large amount of such a photographic material containing a redox compound of the kind is processed continuously, the released development inhibitor would accumulate in the developer tank. When development is continued with such a fatigued developer, the formation of hard images is impossible and the sensitivity of the photographic materials being processed is decreased. In particular, where one automatic developing machine is used for processing photographic materials containing such a redox compound and also for processing other various picture-taking photographic materials, contact-printing photographic materials, scanning photographic materials and photocomposing photographic materials, there occurs a problem that the development inhibitor as released from the redox compound often has a bad influence on the photographic properties of other photographic materials.

Because of these reasons, the amount of the redox compound used is limited so that the effect of the redox compound is not displayed sufficiently, or the photographic material having such a redox compound must be processed with specifically defined processing solutions and only in a specifically closed system. Such limitation or use of such a closed system is inconvenient.

SUMMARY OF THE INVENTION

The first object of the present invention is to provide novel compounds which have an excellent storage stability and rapidly release a development inhibitor.

The second object of the present invention is to provide novel compounds which can be used in a hard photographic material system in an amount sufficient for improving the image reproducibility without fatiguing the developer.

The third object of the present invention is to provide a photographic material for photomechanical processes, which can be processed with a highly stable developer to give a hard image.

The fourth object of the present invention is to provide a hard photographic material for photomechanical processes, which contains a hydrazine nucleating agent and which forms a halftone image with a broad halftone gradation.

The fifth object of the present invention is to provide a photographic material for photomechanical processes, which can be processed stably by continuous processing with a running solution.

These objects were attained by a silver halide photographic material containing a compound of general formula (1):

$$\text{ED-(Time)}_t\text{-Y-L-Z} \qquad (1)$$

wherein ED represents a group that releases the moiety $(\text{Time})_t$-Y-L-Z by reaction with an oxidation product of a developing agent; Time represents a divalent linking group; t represents 0 or 1; Y represents a divalent group comprising a hetero atom through which Y bonds to the moiety ED-$(\text{Time})_t$-; L represents a divalent group which is capable of being cleaved by reaction with components of a developer; and Z represents a functional group that expresses a development inhibiting effect.

In a preferred embodiment, the group ED in formula (1) comprises a redox group having a hydrazine structure and releasing the moiety $(\text{Time})_t$-Y-L-Z by oxidation with an oxidation product of a developing agent.

The objects were also attained by a silver halide photographic material containing a compound of general formula (2):

$$R_1-\underset{\underset{A_1}{|}}{N}-\underset{\underset{A_2}{|}}{N}-G_1-(\text{Time})_t-Y-L-Z \qquad (2)$$

wherein Time, t, L and Z have the same meanings as defined in formula (1); Y represents a divalent group comprising a hetero atom through which Y bonds to the moiety $$R_1-\underset{\underset{A_1}{|}}{N}-\underset{\underset{A_2}{|}}{N}-G_1-(\text{Time})_t;$$

$R_1$ represents an aliphatic group or an aromatic group; $G_1$ represents $$-\overset{O}{\overset{\|}{C}}-,\ -\overset{O}{\overset{\|}{C}}-\overset{O}{\overset{\|}{C}}-,\ -\overset{S}{\overset{\|}{C}}-,\ -\overset{N-G_2-R_2}{\overset{\|}{C}}-,$$

—SO—, —$SO_2$—, or $$-\overset{O}{\overset{\|}{\underset{\underset{G_2-R_2}{|}}{P}}}-;$$

$G_2$ represents a mere bond, or —O—, —S— or $$-\underset{\underset{R_2}{|}}{N}-;$$

$R_2$ has the same meaning as $R_1$ or represents a hydrogen atom; when the molecule has plural $R_2$'s, they may be the same or different; and one of $A_1$ and $A_2$ represents a hydrogen atom, and the other represents a hydrogen atom, an acyl group having 2 to 10 carbon atoms, preferably 1 to 6 carbon atoms, e.g., acetyl, an alkylsulfonyl group having 1 to 10 carbon atoms, preferably 1 to 6 carbon atoms, e.g., methyl sulfonyl or an arylsulfonyl group having 6 to 15 carbon atoms, preferably 6 to 10 carbon atoms, e.g., phenylsulfonyl and p-tolylsulfonyl.

As another preferred embodiment, the silver halide photographic material may contain a hydrazine compound which is different from compounds of formulae (1) and (2) in an image-forming layer containing a silver halide emulsion or in any other hydrophilic colloid layer such as the adjacent hydrophilic colloid layer.

BRIEF DESCRIPTION OF THE DRAWING

FIGURE shows one constitutional embodiment of forming super-imposed letter images by contact exposure, where (a) is a transparent or semitransparent support, (b) is a line original in which the black portions indicate line images, (c) is a transparent or semitransparent support, (d) is a halftone original in which the black portions indicate dot images, and (e) is a dot-to-dot working photographic material in which the shadow portion indicates a light-sensitive layer.

DETAILED DESCRIPTION OF THE INVENTION

Figure 1:
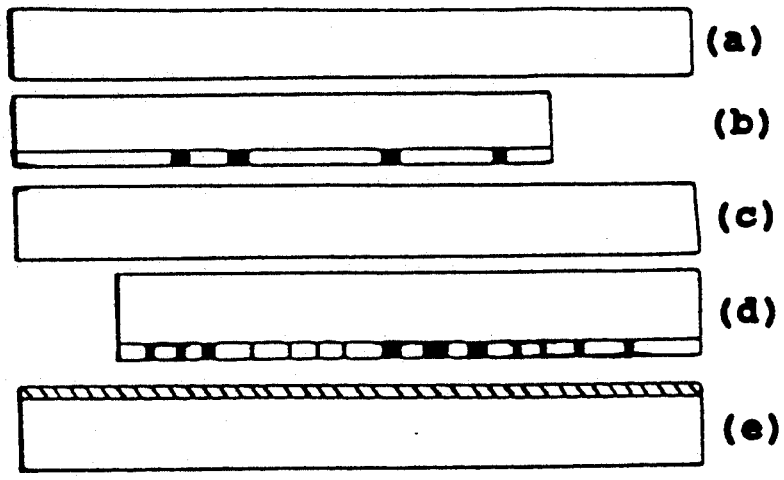

In formula (1), the group represented by ED is one which can release the moiety $(\text{Time})_t$-Y-L-Z by reaction with an oxidation product of a developing agent. More specifically, it is a group releasing the moiety $(\text{Time})_t$-Y-L-Z by a coupling reaction with an oxidation product of an aromatic amine developing agent, or a redox group which is first oxidized with an oxidation product of a developing agent of various kinds and then releases the moiety $(\text{Time})_t$-Y-L-Z via the successive one-stage or plural-stages reaction.

Preferably, ED is a redox group. Preferred examples of such a redox group of ED include hydroquinones, catechols, naphthohydroquinones, aminophenols, pyrazolidones, hydrazines, hydroxylamines and reductones. Hydrazines are especially preferred.

In formula (2), the aliphatic group represented by $R_1$ is preferably one having from 1 to 30 carbon atoms, and especially preferably a linear, branched or cyclic alkyl group having from 1 to 20 carbon atoms. The alkyl group optionally may have substituent(s).

In formula (2), the aromatic group represented by $R_1$ is a monocyclic or bicyclic aryl or unsaturated heterocyclic group. The unsaturated heterocyclic group optionally may be condensed with an aryl group to form a heteroaryl group.

For example, the aromatic group is preferably one derived from benzene rings, naphthalene rings, pyridine rings, quinoline rings and isoquinoline rings. Especially preferred is an aromatic group that contains a benzene ring.

$R_1$ is preferably an aryl group.

The aryl group or unsaturated heterocyclic group represented by $R_1$ optionally may be substituted. Typical examples of substituents for such a substituted aryl or unsaturated heterocyclic group include an alkyl group, an aralkyl group, an alkenyl group, an alkynyl group, an alkoxy group, an aryl group, a substituted amino group, a ureido group, a urethane group, an aryloxy group, a sulfamoyl group, a carbamoyl group, an alkylthio group, an arylthio group, a sulfonyl group, a sulfinyl group, a hydroxyl group, a halogen atom, a cyano group, a sulfone group, an aryloxycarbonyl group, an acyl group, an alkoxycarbonyl group, an acyloxy group, a carbonamido group, a sulfonamido group, a carboxyl group and a phosphorylamido group. Preferred substituents are a linear, branched or cyclic alkyl group (preferably having from 1 to 20 carbon atoms), an aralkyl group (preferably having from 7 to 30 carbon atoms), an alkoxy group (preferably having from 1 to 30 carbon atoms), a substituted amino group (preferably an amino group substituted by alkyl group(s) each having from 1 to 30 carbon atoms), an acylamino group (preferably having from 2 to 40 carbon atoms), a sulfonamido group (preferably having from 1 to 40 carbon atoms), a ureido group (preferably having from 1 to 40 carbon atoms) and a phosphorylamido group (preferably having from 1 to 40 carbon atoms).

In formula (2), $G_1$ is preferably $$-\overset{\overset{\displaystyle O}{\|}}{C}-$$

or $-SO_2-$, and is most preferably $$-\overset{\overset{\displaystyle O}{\|}}{C}-.$$

$A_1$ and $A_2$ are preferably hydrogen atoms.

In formulae (1) and (2), Time represents a divalent linking group, which may have a timing-regulating function. The divalent group represented by Time is one which releases the moiety Y-L-Z from the moiety Time-Y-L-Z as released from ED, via a one-step or plural-step reaction.

Examples of the divalent linking group of Time include p-nitro-phenoxy derivatives releasing the moiety Y-L-Z by an intramolecular ring-closure reaction as described in U.S. Pat. No. 4,248,962 (JP-A-54-145135); compounds releasing the moiety Y-L-Z by a ring-cleavage reaction followed by an intramolecular ring-closure reaction as described in U.S. Pat. Nos. 4,310,612 (JP-A-55-53330) and 4,358,252; succinic acid monoesters or analogues thereof releasing the moiety Y-L-Z by an intramolecular ring-closure reaction of the carboxyl group along with formation of an acid anhydride as described in U.S. Pat. Nos. 4,330,617, 4,446,216 and 4,483,919 and JP-A-59-121328; compounds releasing the moiety Y-L-Z by electron transfer of the aryloxy or heterocyclic-oxy group via the conjugated double bond to form a quinomonomethane or an analogue thereof as described in U.S. Pat. Nos. 4,409,232, 4,421,845, RESEARCH DISCLOSURE Item No. 2,228 (December, 1981), U.S. Pat. No. 4,416,977 (JP-A-57-135944) and JP-A-58-209736 and JP-A-58-209738; compounds releasing the moiety Y-L-Z by electron transfer of the enamine structure moiety of the nitrogen-containing hetero ring from the gamma-position of the enamine as described in U.S. Pat. No. 4,420,554 (JP-A-57-136640), and JP-A-57-135945, JP-A-57-188023, JP-A-58-98728 and JP-A-58-209737; compounds releasing the moiety Y-L-Z by an intramolecular ring-closure reaction of the hydroxyl group as formed by electron transfer of the carbonyl group as conjugated with the nitrogen atom of the nitrogen-containing hetero ring, as described in JP-A-57-56837; compounds releasing the moiety Y-L-Z with formation of aldehydes as described in U.S. Pat. No. 4,146,396 (JP-A-52-90932) and JP-A-59-93442, JP-A-59-75475, JP-A-60-249148 and JP-A-60-249149; compounds releasing the moiety Y-L-Z with decarbonylation of the carboxyl group as descried in JP-A-51-146828, JP-A-57-179842 and JP-A-59-104641; compounds having $-O-COOCR_aR_b-Y-L-Z$ (wherein $R_a$ and $R_b$ each represents a monovalent group) and releasing the moiety Y-L-Z by decarbonylation followed by formation of aldehydes; compounds releasing the moiety Y-L-Z with formation of isocyanates as described in JP-A-60-7429; and compounds releasing the moiety Y-L-Z by a coupling reaction with the oxidation product of a color developing agent as described in U.S. Pat. No. 4,438,193.

Examples of divalent linking groups of Time are also described in detail in JP-A-61-236549, JP-A-1-269936 and Japanese Patent Application No. 2-93487.

In formulae (1) and (2), the divalent group represented by Y has hetero atom(s) and is bonded to the moiety of $ED-(Time)_t-$ in formula (1) or to the moiety of $$R_1-\underset{\underset{\displaystyle A_1}{|}}{N}-\underset{\underset{\displaystyle A_2}{|}}{N}-G_1-(Time)_t-$$

in formula (2) via the hetero atom.

The group represented by -Y-L-Z in formula (1) or (2) is preferably one represented by the following formula (3) or (4). It is especially preferably the group of formula (4).

$$-Y_1-Y_2-L-Z \qquad (3)$$

wherein $Y_1$ represents —O—, —S—, —Se—, —Te— or $$-\underset{\underset{\displaystyle R_3}{|}}{N}-;$$

$R_3$ represents a hydrogen atom or has the same meaning as $R_1$ in formula (2); $Y_2$ represents an aliphatic group having 1 to 20 carbon atoms, preferably 1 to 15 carbon atoms, and more preferably 1 to 10 carbon atoms or an aromatic group having 2 to 20 carbon atoms, preferably 3 to 15 carbon atoms, and more preferably 5 to 10 carbon atoms, or it can also be a divalent group formed by combination of such an aliphatic or aromatic group and —O—, —S—, —Se—,

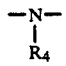

(wherein $R_4$ has the same meaning as $R_3$), —CO—, —SO— or —$SO_2$—. The group of $Y_2$ optionally may be substituted, and the total number of carbon atoms of $Y_2$ is 1 to 30, preferably 1 to 20 and more preferably 1 to 15. Preferred examples of substituents for $Y_2$ are the same as those for $R_1$.

L and Z have the same meanings as those in formulae (1) and (2).

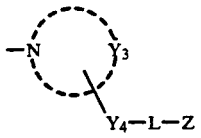

(4)

wherein L and Z have the same meanings as in formulae (1) and (2); $Y_4$ represents a single bond or has the same meaning as $Y_2$ in formula (3); and $Y_3$ represents a non-metallic atomic group that forms a nitrogen-containing hetero ring with the nitrogen atom in the formula.

In formula (4), the nitrogen-containing hetero ring represented by:

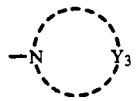

is preferably a heterocyclic aromatic ring, and more preferably a 5-membered or 6-membered ring which can be either a monocyclic group or a condensed ring and which may be substituted.

Typical examples of preferred heterocyclic aromatic rings are pyrroles, imidazoles, pyrazoles, 1,2,3-triazoles, 1,2,4-triazoles, tetrazoles, 2-thioxathiazolines, 2-oxathiazolines, 2-thioxaoxazolines, 2oxaoxazolines, 2-thioxaimidazolines, 2-oxaimidazolines, 3-thioxa-1,2,4-triazolines, 3-oxa-1,2,4-triazolines, 1,2-oxazoline-5-thiones, 1,2-thiazoline-5-thiones, 1,2-oxazolin-5-ones, 1,2-thiazolin-5-ones, 2-thioxa-1,3,4-thiadiazolines, 2-oxa-1,3,4-thiadiazolines, 2-thioxa-1,3,4-oxadiazolines, 2-oxa-1,3,4-oxadiazolines, 2-thioxadihydropyridines, 2-oxadihydropyridines, 4-thioxadihydropyridines, 4-oxadihydropyridines, isoindoles, indoles, indazoles, benzotriazoles, benzimidazoles, 2-thioxabenzimidazoles, 2-oxabenzimidazoles, benzoxazoline-2-thiones, azaindenes, benzoxazolin-2-ones, benzothiazoline-2-thiones, benzothiazolin-3-ones, carbazoles, purines, carbolines, phenoxazines and phenothiazines; as well as condensed heterocyclic aromatic rings having condensed ring(s) at various position(s), such as pyrazolopyridines, pyrazolopyrimidines, pyrazolopyrroles, pyrazolopyrazoles, pyrazoloimidazoles, pyrazoloxazoles, pyrazolothiazoles, pyrazolotriazoles, imidazolopyridines, imidazolopyrimidines, imidazolopyrroles, imidazoloimidazoles, imidazoloxazoles, imidazolothiazoles and imidazolotriazoles.

More preferred examples of such heterocyclic aromatic rings are pyrroles, pyrazoles, triazoles, tetrazoles, 2-thioxathiazolines, 2-thioxaoxazolines, indoles, indazoles, benzotriazoles, benzimidazoles, 2-thioxa-1,3,4-thiadiazolines, azaindenes, 5-thioxatetrazolines, 2-thioxa-1,3,4-oxadiazolines, and 2-thioxa-1,2,4-triazolines; as well as condensed heterocyclic aromatic rings having condensed ring(s) at various position(s), such as pyrazolopyridines and pyrazoloimidazoles. Especially preferred are pyrazole skeleton-containing heterocyclic aromatic rings such as pyrazoles, indazoles and pyrazolopyridines.

The heterocyclic compounds may optionally be substituted. Examples of substituents for such compounds include a mercapto group, a nitro group, a carboxyl group, a sulfo group, a phosphono group, a hydroxyl group, an alkyl group, an aralkyl group, an alkenyl group, an alkynyl group, an aryl group, an alkoxy group, an aryloxy group, an amino group, an acylamino group, a sulfonylamino group, an ureido group, an urethane group, a sulfamoyl group, a carbamoyl group, an alkylthio group, an arylthio group, a sulfonyl group, a sulfinyl group, a halogen atom, a cyano group, an aryloxycarbonyl group, an acyl group, an alkoxycarbonyl group, an acyloxy group, a carbonamido group, a sulfonamido group and a phosphonamido group.

In formulae (1) and (2), the group represented by L is one which may be cleaved by reaction with components of a developer. Examples of components of a developer which cleave the group L are compounds which are contained in an ordinary developer, such as alkali substances, hydroquinones and sulfite ions, as well as surfactants, amines and salts of organic acids. To effect cleavage of the group L, particular reagents such as fluoride ions, hydrazines and hydroxylamines may be added to a developer. The group L may be cleaved by the complex reaction of the components.

In the compounds of formula (1) or (2), the moiety Y-L-Z is released by reaction with an oxidation product of a developing agent (and the successive reaction), in accordance with the reaction scheme mentioned below. Where the moiety Y-L-Z is released in the step of development, it is desired that the reaction of cleavage of L by the components of a developer (the reaction being represented by Y-L-Z→Y-$L_1$+$L_2$-Z) occurs substantially after the reaction of releasing the moiety Y-L-Z. In addition, since it is desired that the cleavage of the group L occurs substantially after the release of the moiety Y-L-Z, the reaction is often confounded with the reaction of the divalent linking group represented by Time in formula (1) or (2). However, in the reaction of the group Time, release of the moiety Time-Y-L-Z from the compound is the essential factor of the successive reaction of releasing the moiety Y-L-Z from the moiety Time-Y-L-Z. That is to say, the moiety Y-L-Z is released substantially only after release of the moiety Time-Y-L-Z. As opposed to this, it is desired that cleavage of the group L occurs irrespective of the release of the moiety Y-L-Z. That is to say, cleavage of the group L may occur by the action of the components of a developer even in the absence of release of Time-Y-L-Z or Y-L-Z.

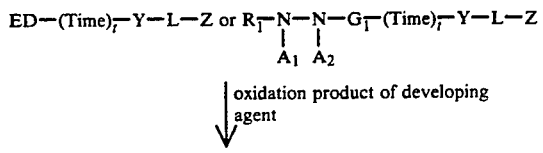

-continued $$Y-L-Z \xrightarrow{\text{components of developer}} Y-L_1,\ L_2-Z$$

As shown above, where it is represented that Y-L-Z is converted into Y-$L_1$ and $L_2$-Z by cleavage of L, it is desired that $L_2$ contains an anionic functional group. More preferably, $L_2$ contains a conjugated base of an acidic functional group having a pKa of 6 or less as a functional group, and especially preferably a conjugated base of an acidic functional group having a pKa of 5 or less as a functional group. Preferred examples of such functional groups are a carboxyl group, a sulfonic acid group, a sulfinic acid group, a phosphoric acid group, a phosphonic acid group and a phosphinic acid group. It is desired that such a functional group is formed by cleavage of the group L.

In formulae (1) and (2), the group represented by L-Z is preferably one of the following formulae (5) to (8) wherein Z has the same meaning as that in formulae (1) and (2).

$$-L_3-L_4-Z$$

wherein $L_3$ represents $$-O-\overset{\overset{\displaystyle O}{\|}}{C}-,\ -S-\overset{\overset{\displaystyle O}{\|}}{C}-,$$

$$-O-SO_2-,$$

$$-O-\underset{\underset{\displaystyle R_5}{|}}{SO_2N}- \text{ or } -O-\underset{\underset{\displaystyle O}{\|}}{P(OR_5)}-;$$

$R_5$ represents a hydrogen atom or has the same meaning as $R_1$ in formula (2); $L_4$ has the same meaning as $Y_4$ in formula (4); and Z has the same meaning as that in formulae (1) and (2).

$$-L_5-\underset{\underset{\displaystyle L_6}{|}}{C}=\underset{\underset{\displaystyle L_6}{|}}{C}-L_7-L_4-Z \qquad (6)$$

wherein $L_5$ represents $$-\overset{\overset{\displaystyle O}{\|}}{C}-$$

$-SO_2-$; $L_6$ represents a monovalent group, and two $L_6$'s may be the same or different or may be bonded to each other to form a ring; or one or both of the two $L_6$'s may be bonded to the group Y of formula (1) or (2) to form a ring or a polycyclic ring; $L_7$ represents —O—, —S— or $-SO_2-$; $L_4$ has the same meaning as that in formula (5); and Z has the same meaning as that in formulae (1) and (2).

$$-L_5-\underset{\underset{\displaystyle L_6}{|}}{CH}-\overset{\overset{\displaystyle L_6}{|}}{\underset{\underset{\displaystyle L_6}{|}}{C}}-L_7-L_4-Z \qquad (7)$$

wherein $L_4$, $L_5$, $L_6$, $L_7$ and Z have the same meanings as those in formula (6).

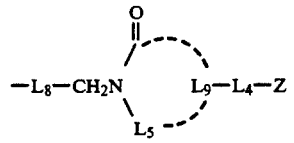

(8)

wherein L4 has the same meaning as in formula (5); Z has the same meaning as in formulae (1) and (2); $L_5$ has the same meaning as in formula (6); $L_8$ has the same meaning as $Y_1$ in formula (3); and $L_9$ represents a non-metallic atomic group necessary for forming a 5- or 6-membered cyclic structure together with the nitrogen atom, $L_5$ and carbonyl group in the formula.

In formulae (1) and (2), the group represented by Z is a functional group that expresses a development inhibiting activity. Preferably, Z represents a development inhibitor in the form of Y-L-Z. After cleavage of L, the resulting $L_2$-Z is a compound having a small development inhibiting activity. If desired, Z may form together with the group Y in formula (1) or (2) any bond other than the bond via L therebetween. Thus, Y, L and Z form a cyclic structure which is opened by cleavage of L.

Y-L-Z preferably represents a development inhibitor. Examples of known conventional development inhibitors are described, for example, in T. H. James, *The Theory of Photographic Processes,* 4th Ed. (published by Macmillan Co., 1977), pages 396 to 399 and in Japanese Patent Application No. 2-93487, pages 56 to 69.

Such development inhibitors are preferably substituted. Examples of substituents are the above-mentioned substituents for $R_1$ in formula (2). The substituents may be substituted further.

The development inhibitors of Y-L-Z which are used in the present invention, are especially preferably compounds capable of inhibiting nucleating infectious development.

Nucleating infectious development is a novel development chemistry which has been employed in image formation with the Fuji Film GRANDEX System (by Fuji Photo Film Co., Ltd.) or with the Kodak Ultratec System (by Eastman Kodak Co., Ltd.).

The novel development chemistry, described in *Journal of Japan Photographic Association,* Vol. 52, No. 5, pages 390 to 394 (1989) and *Journal of Photographic Science,* Vol. 35, page 162 (1987), is composed of a development step where exposed silver halide grains are exposed with an ordinary developing agent and the successive nucleating infectious development step where the oxidation product of the developing agent as formed in the previous development step is oxidized with a nucleating agent by cross-oxidation to form an active nucleating seed, and the ambient non-exposed or weakly exposed silver halide grains are developed with the resulting active seeds by nucleating infectious development.

Accordingly, since the complete development step is composed of an ordinary development step and the successive nucleating infectious development step, novel compounds capable of retarding the nucleating infectious development step may display a development inhibiting activity in addition to the conventional ordinary development inhibitors which have heretofore been known and used in the system. The former novel compounds are herein referred to as nucleating development inhibitors.

The development inhibitor of Y-L-Z used in the present invention is preferably a nucleating development inhibitor. Accordingly, the functional group of Z, which expresses a development inhibiting effect, is also preferably a functional group of expressing an effect of inhibiting nucleating infectious development. Typical examples of groups of Z of expressing such an effect of inhibiting nucleating infectious development are advantageously conventional mercapto group and azole groups. Preferably, Z is a nitro group; a nitroso group; a nitrogen-containing heterocyclic group, especially a 6-membered nitrogen-containing heterocyclic aromatic group, such as one derived from pyridines, pyrazines or quinolines; a functional group having an N-halogen bond; a group derived from quinones, tetrazolium compounds or amine oxides; an azoxy group; or a group derived from a coordination compound having an oxidizing potency.

Especially preferred are a nitro group and a pyridine group.

Where Z is a nitro group, L preferably contains an aromatic ring as the partial structure of itself and it is preferred that Z is bonded to the aromatic ring moiety of L.

Y-L-Z as used in the present invention means a development inhibitor, and it may be considered that Y-L-Z contains a development inhibiting moiety and a moiety to be released from GI or Time along with a moiety of cleaving from the molecule by reaction with components in a developer, as the partial structure thereof.

As the development inhibiting moiety of Y-L-Z, a structure of any known development inhibitor may be employed.

Specific examples of nucleating development inhibitor moieties which can be used in the present invention are described below.

1. Nitro group-containing compounds (including those having a nitro group(s) at any possible positions):
(1) Nitrobenzene, Nitrotoluene;
(2) Dinitrobenzene, Dinitrotoluene;
(3) Nitrobenzoates;
(4) Dinitrobenzoates;
(5) Nitrobenzoic acid amides;
(6) Dinitrobenzoic acid amides
(7) Nitronaphthalenes;
(8) Nitropyrazoles;
(9) Nitroimidazoles;
(10) Nitropyrroles;
(11) Mono- or di-nitroindoles;
(12) Mono- or di-nitroindazoles;
(13) Mono or di-nitrobenzimidazoles;
(14) Nitrobenzotriazoles;
(15) Nitropyridines;
(16) Nitropyrimidines;
(17) Nitrobenzothiazoles;
(18) Nitrobenzoxazoles;
(19) Nitroquinolines;
(20) Nitrotetrazaindenes;

2. Nitroso group-containing compounds (including those having a nitroso group(s) at any possible positions):
(1) Nitrosobenzenes, dinitrosobenzenes;
(2) Nitrosonaphthalenes, dinitrosonaphthalenes;
(3) Nitrosopyridines;
(4) Nitrosopyrimidines;
(5) N-nitrosoanilines;
(6) N-nitrosoacetanilides;
(7) N-nitroso-2-oxazolidones;
(8) N-nitroso-N-benzyltoluenesulfonamides.

3. Nitrogen-containing hetero rings:
(1) Pyridines;
(2) Nicotinates, Nicotinic acid amides;
(3) Isonicotinates, Isonicotinic acid amides;
(4) Pyrazines;.
(5) Indolidines;
(6) Quinolidines;
(7) Quinolines;
(8) Isoquinolines;
(9) Phthalazines;
(10) Naphthidines;
(11) Quinoxalines;
(12) Quinazolines;
(13) Phthalidines;
(14) Carbazoles;
(15) Phenanthridines;
(16) Acridines;
(17) Phenanthrolines;
(18) Phenatidines;
(19) Phenothiazines;
(20) Phenarsazines.

4 N-halogen bond-having compounds:
(1) N-chlorosuccinic acid imides.

5. Quinones:
(1) Benzoquinones;
(2) Chlorobenzoquinones;
(3) Naphthoquinones;
(4) Anthraquinones.

6. Tetrazoliums:
(1) 2,3,5-triphenyltetrazolium chlorides.

7. Amine oxides:
(1) Pyridine oxides;
(2) Quinoline oxides.

8 Azoxy compounds:
(1) Azoxybenzenes.

9. Oxidizing potency-having coordination compounds:
(1) EDTA-Fe(III) complexes.

The nulceating development inhibiting moiety employed in the present invention advantageously contains a structure derived from the above-mentioned compounds and other development inhibitors as a partial structure thereof. In particular, it is preferred that the group of Y-L-Z in formula (1) or (2) contains a residue derived from the illustrated compounds as a partial structure thereof. The nucleating development inhibitors employable in the present invention optionally may be substituted.

Examples of preferred substituents for the nucleating development inhibitors include the following groups which may be substituted further.

For instance, there are mentioned an alkyl group, an aralkyl group, an alkenyl group, an alkynyl group, an alkoxy group, an aryl group, a substituted amino group, an acylamino group, a sulfonylamino group, a ureido group, a urethane group, an aryloxy group, a sulfamoyl group, a carbamoyl group, an alkylthio group, an arylthio group, a sulfonyl group, a sulfinyl group, a hydroxyl group, a halogen atom, a cyano group, a sulfo group, an alkyloxycarbonyl group, an aryloxycarbonyl group, an acyl group, an alkoxycarbonyl group, an acyloxy group, a carbonamido group, a sulfonamido group, a carboxyl group, a sulfoxy group, a phosphono group, a phosphinyl group and a phosphonylamido group.

ED or Time in formula (1) or $R_1$ or Time in formula (2) may contain a ballast group therein, which is ordinarily contained in passive (or inactive) photographic additives such as couplers, or may also contain a group therein, which may promote adsorption of the compound of formula (1) or (2) to silver halides.

Such a ballast group is an organic group which may impart a sufficient molecular weight to the compound of formula (1) or (2) in order that the compound could not diffuse substantially to other layers or to processing solutions, and it is composed of one or more of an alkyl group, an aryl group, a heterocyclic group, an ether group, a thioether group, an amido group, a ureido group and a sulfonamido group. A preferred example of such a ballast group is one having substituted benzene ring(s); and a ballast group having benzene ring(s) substituted with branched alkyl group(s) is especially preferred.

Examples of the other group capable of promoting absorption of the compound of formula (1) or (2) to silver halides include, for example, cyclic thioamido groups such as 4-thiaozline-2-thione, 4-imidaozline-2-thione, 2-thiohydantoin, rhodanine, thiobarbituric acid, tetrazoline-5-thione, 1,2,4-triazoline-3-thione, 1,3,4-oxazoline-2-thione, benzimidazoline-2-thione, benzoxazoline-2-thione, benzothiazoline-2-thione, thiotriazine and 1,3-imidaozline-2-thione; linear thioamido groups; aliphatic mercapto groups; aromatic mercapto groups; heterocyclic mercapto groups (when a nitrogen atom is adjacent to the carbon atom bonded to —SH, the groups have the same meaning as the cyclic thioamido groups which are tautomers of the groups, and specific examples of the groups are the same as those described above); disulfido bond-containing groups, 5-membered or 6-membered nitrogen-containing heterocyclic groups composed of a combination of nitrogen, oxygen, sulfur and carbon atoms, such as benzotriazoles, triazoles, tetrazoles, indazoles, benzimidazoles, imidazoles, benzothiazoles, thiazoles, thiazolines, benzoxazolines, oxazoles, oxazolines, thiadiazoles, oxathiazoles, triazines and azaindenes; as well as heterocyclic quaternary salts such as benzimidazoliums.

The groups may further be substituted by appropriate substituent(s), if desired.

Examples of the substituents include those described for the group $R_1$ in the above-described formula (2).

Specific examples of the compounds of the above-described formulae (1) or (2) which can be used in the present invention are described below, but the present invention is not limited thereto. In the formulae, the group

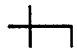

represents $—C(CH_3)_2—CH_2—CH_3$.

1

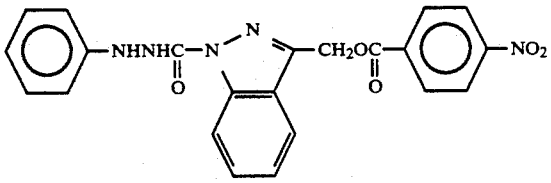

2

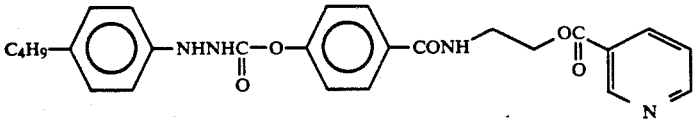

3

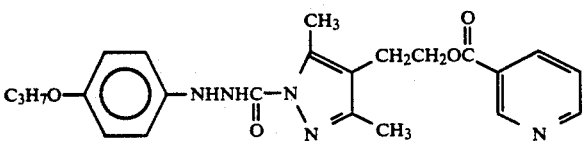

4

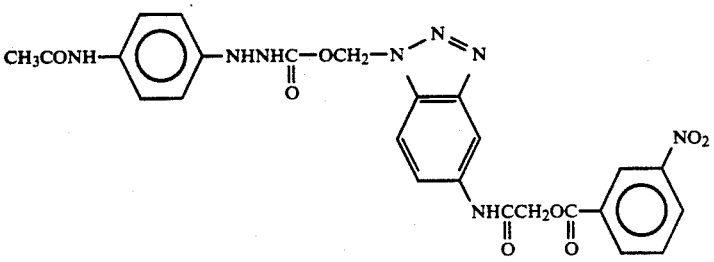

-continued
5
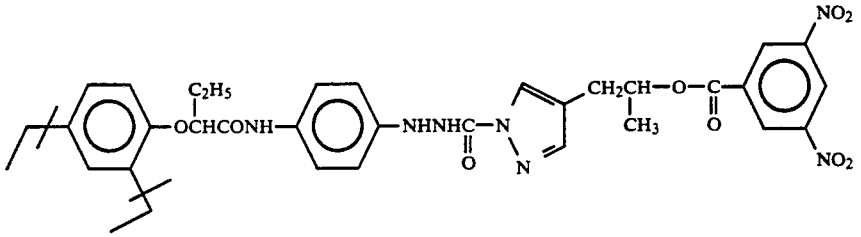
6
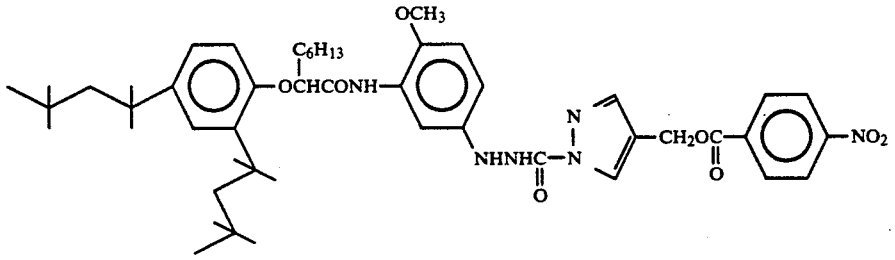
7
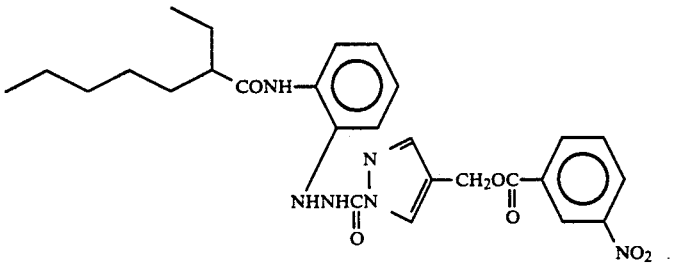
8
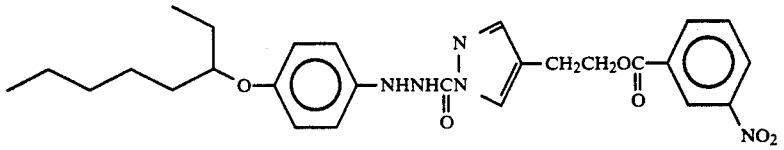
9
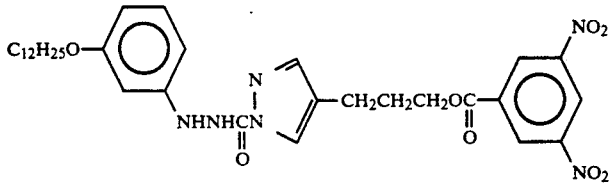
10
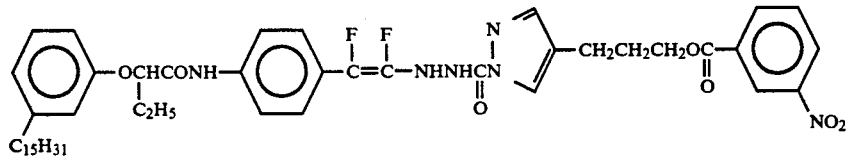
11
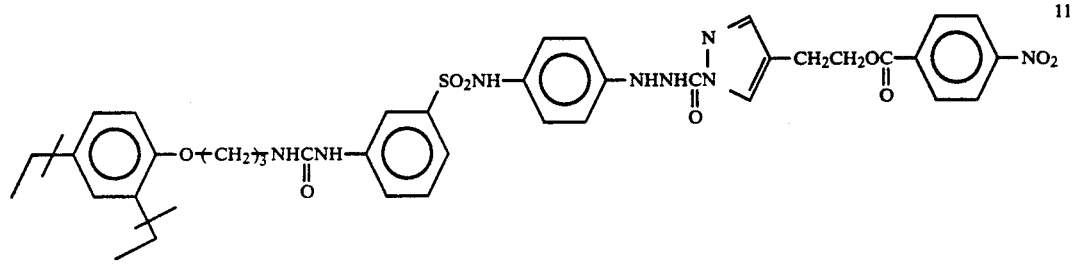

-continued
12
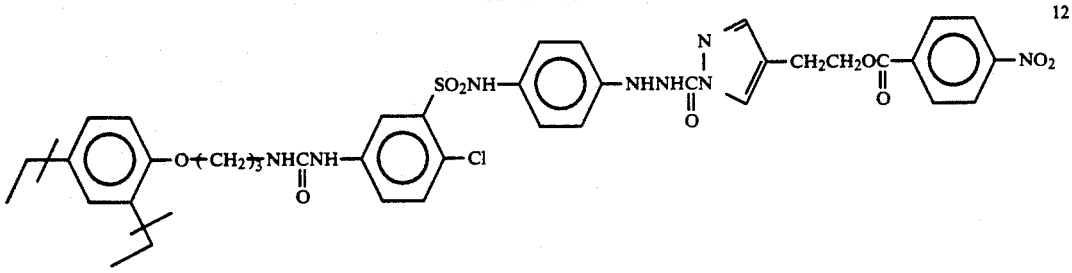
13
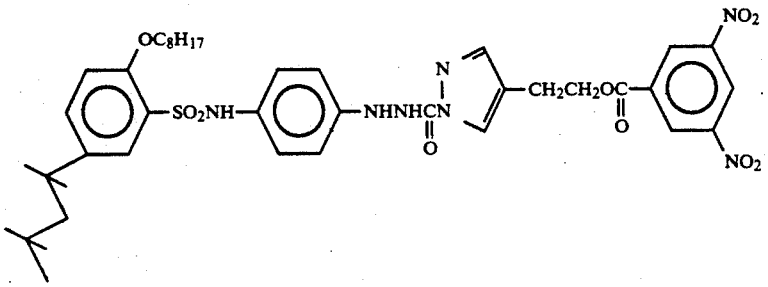
14
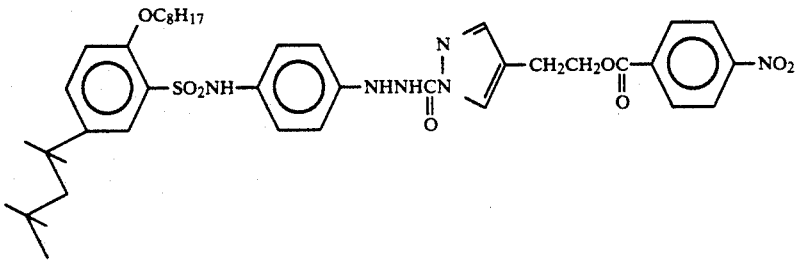
15
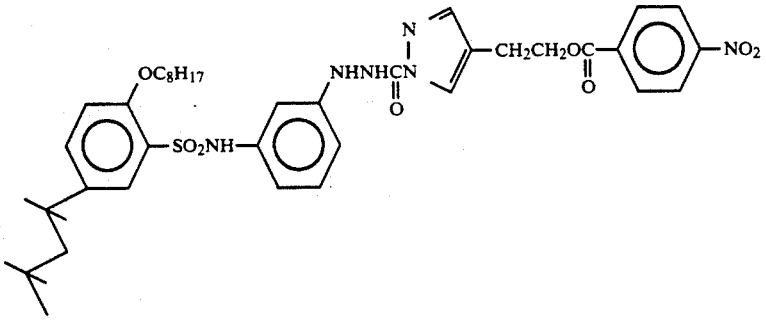
16
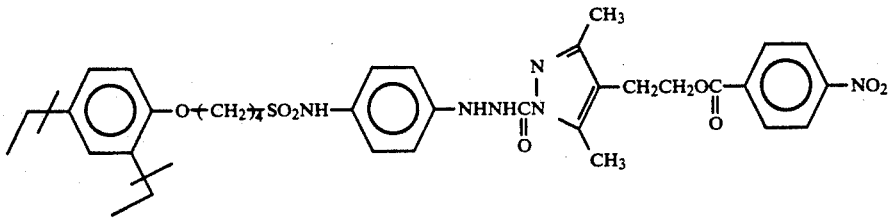
17
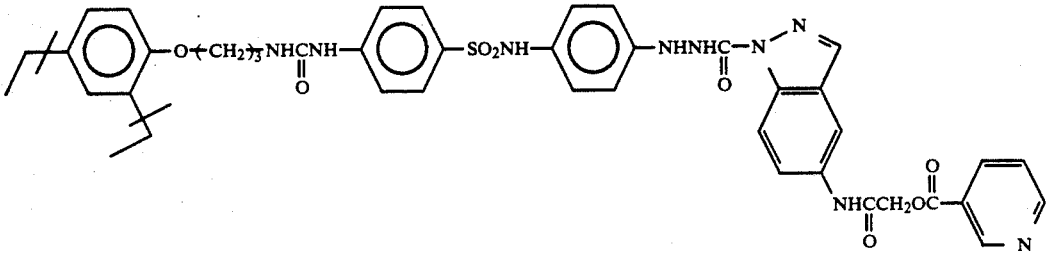

-continued
18
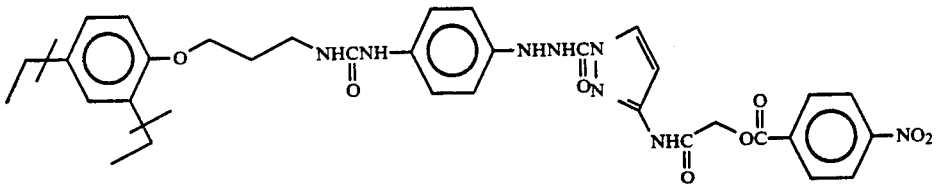
19
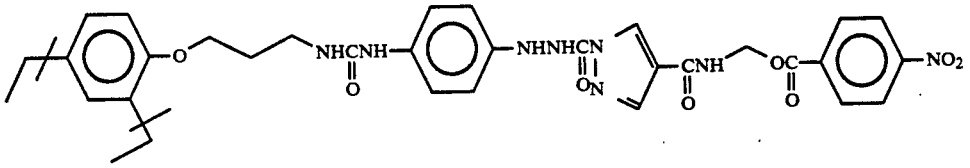
20
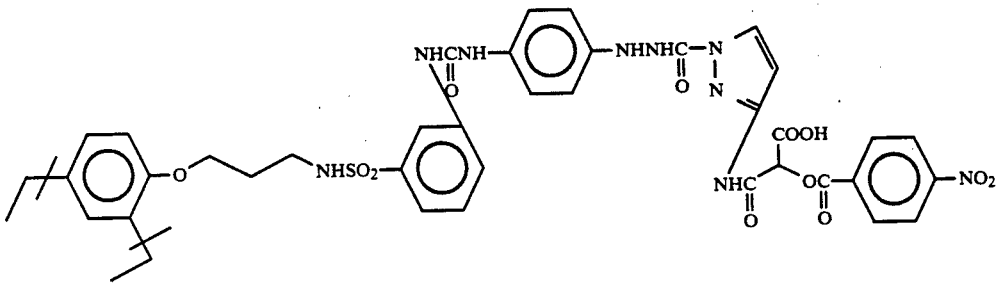
21
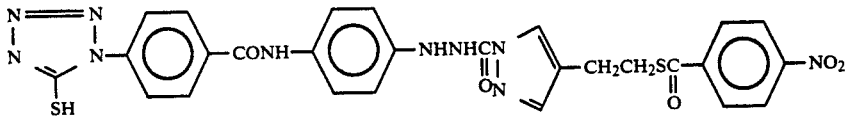
22
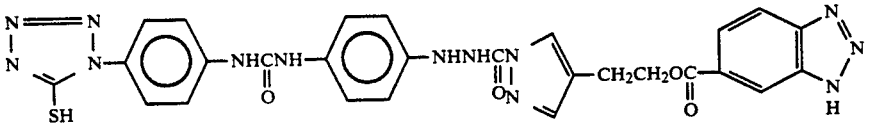
23
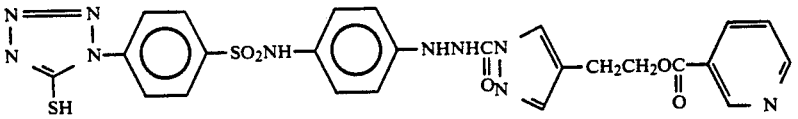
24
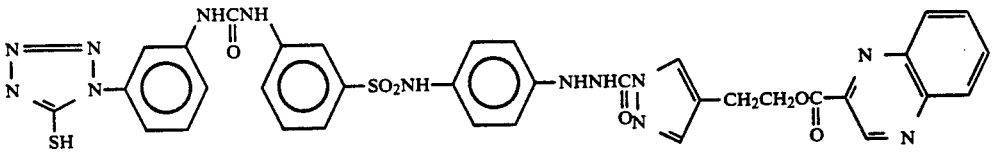
25
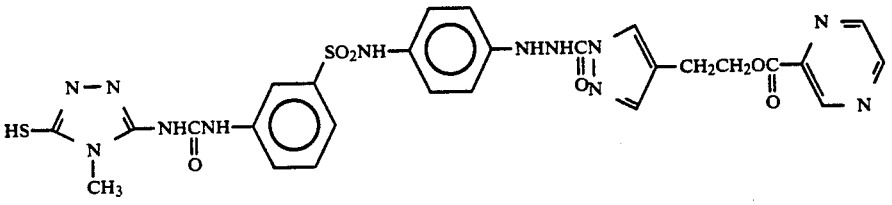
26
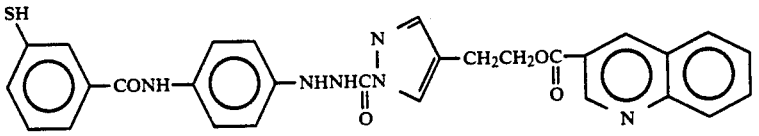

-continued
27
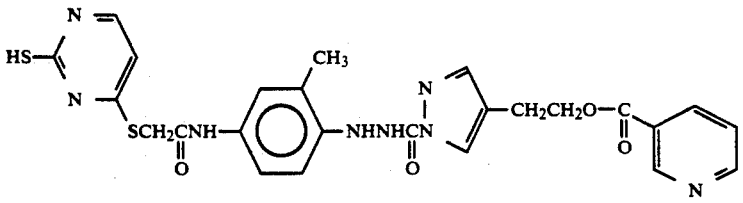
28
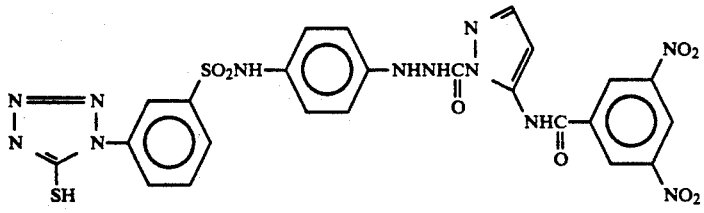
29
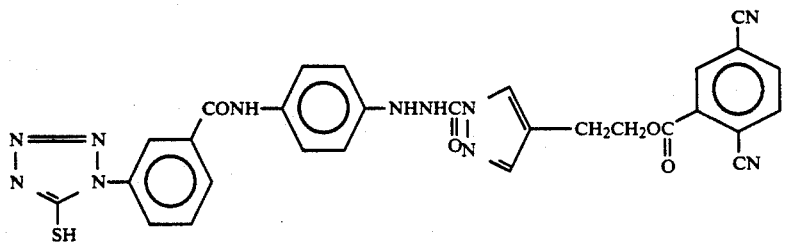
30
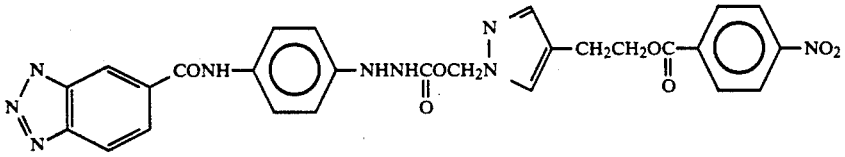
31
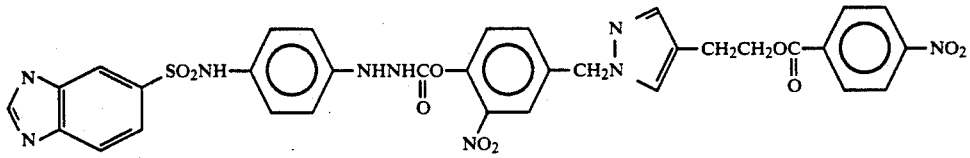
32
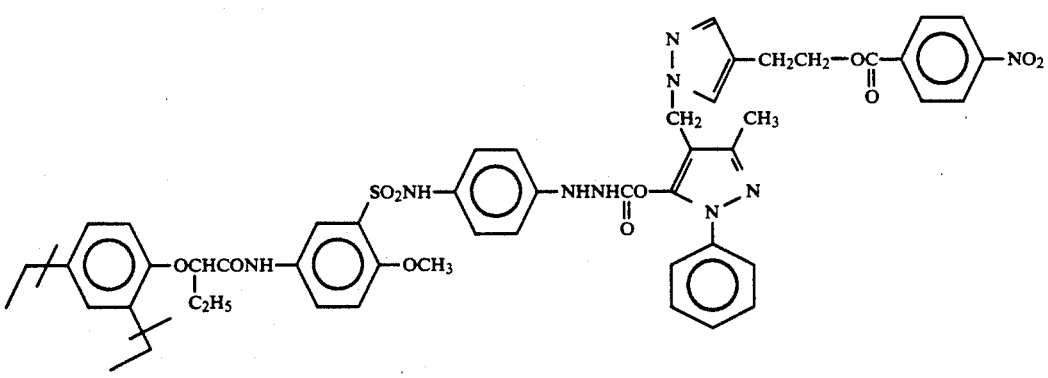
33
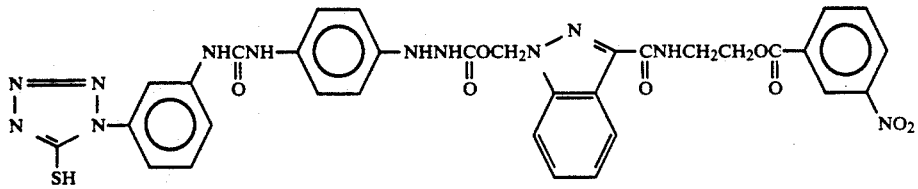

-continued
34
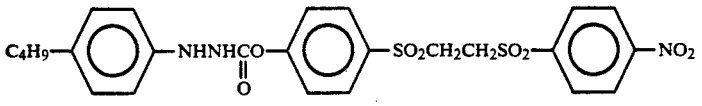
35
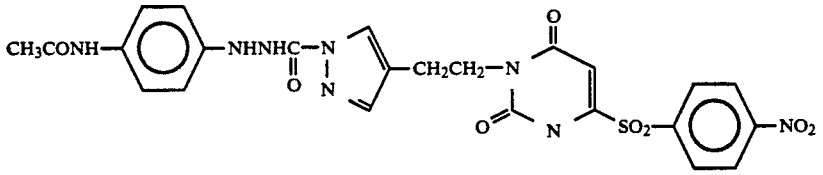
36
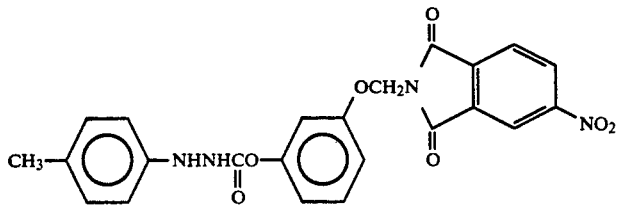
37
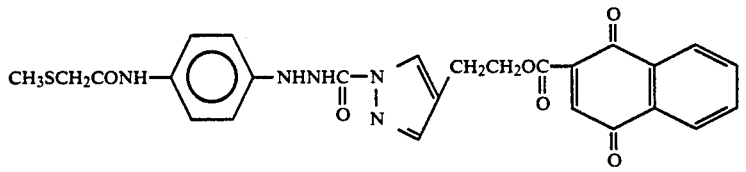
38
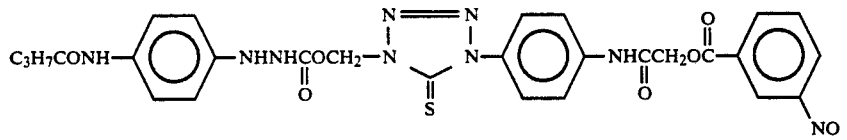
39
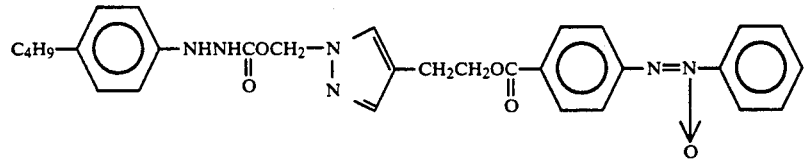
40
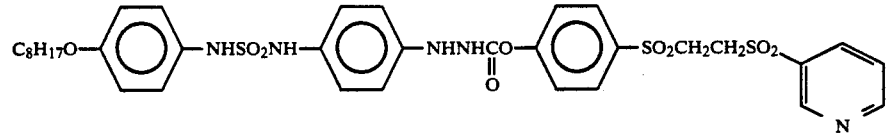
41
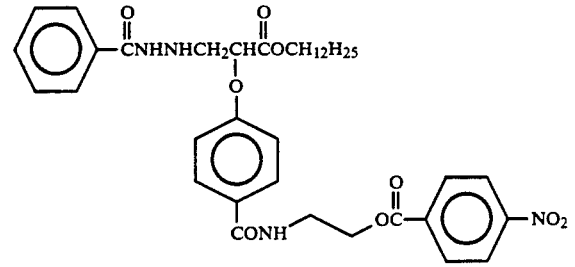

-continued

42

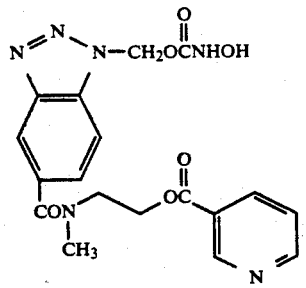

43

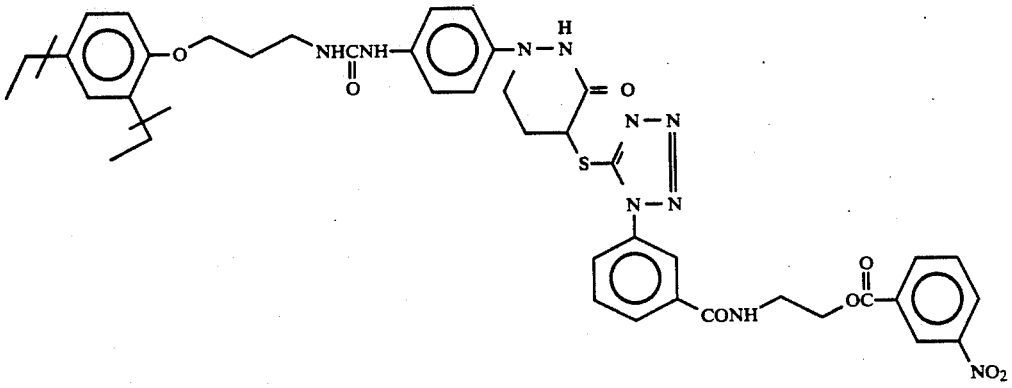

Compounds of formula (2) for use in the present invention are produced in accordance with the routes described below. More specifically, two equivalents of the corresponding Z-L-Y-(Time)$_r$-H are reacted with trichloromethyl chlorocarbonate in an organic solvent such as terehydrofuran (THF) in the presence of a base such as triethylamine to give a symmetric carbonyl compound and thereafter the resulting carbonyl compound is reacted with a corresponding hydrazine compound to produce the desired compound of formula (2) (Production Route-1); or a corresponding Z-L-Y-(Time)$_r$-H is condensed with p-nitrophenyl chlorocarbonate in the presence of a base and thereafter reacted with a corresponding hydrazine compound to produce the desired compound of formula (2) (Production Route-2).

PRODUCTION ROUTE 1:

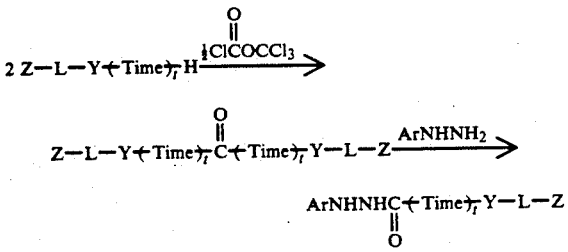

PRODUCTION ROUTE-2:

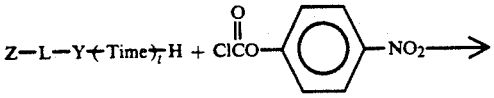

-continued

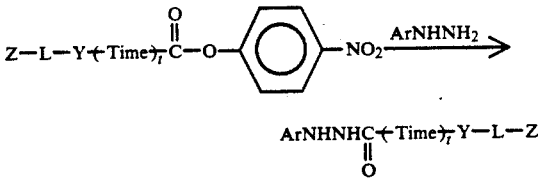

Concrete methods for producing the compounds for use in the present invention are described, for example, in JP-A-61-213847, JP-A-62-260153, JP-A-3-39953, Jp-A-3-39951 and 3-39949. An example of producing one of such compounds is presented below.

PRODUCTION OF COMPOUND NO. 14:

(i) Production of 1-t-butoxycarbonyl-4-β-hydroxyethylpyrazole (1):

31.9 ml of triethylamine and 50.0 g of di-tert-butyl dicarbonate were added to a mixture comprising 25.7 g of 4-β-hydroxypyrazole and 100 ml of acetonitrile and stirred for 2 days at room temperature. The resulting blend was poured into 500 ml of an aqueous solution of hydrochloric acid of the same molar amount as triethylamine and then extracted with ethyl acetate. Anhydrous magnesium sulfate was added thereto for drying, and ethyl acetate was removed by distillation under reduced pressure. As a result, compound (1) was obtained as a colorless tar, with a yield of 21.6 g.

(ii) Production of Compound (2)

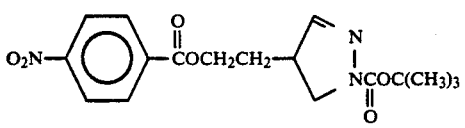

(2)

A solution of 20.4 g of p-nitrobenzoyl chloride dissolved in 100 ml of tetrahydrofuran was added to a mixture comprising 21.6 g of compound (1), 100 ml of tetrahydrofuran and 15.3 ml of triethylamine in a nitrogen atmosphere at −5° C. to 5° C. The temperature of the resulting mixture was gradually elevated up to room temperature and then stirred for 4 hours. Afterwards, the resulting blend was poured into water and the solid that precipitated was taken out by filtration. The thus obtained solid was purified by column chromatography to obtain compound (2) with a yield of 24.4 g.

(iii) Production of Compound (3)

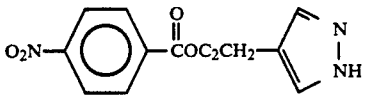

(3)

30 ml of trifluoroacetic acid was added to 24.4 g of compound (2) and stirred for 4 hours at room temperature. Then the resulting blend was poured into water and the solid that precipitated was taken out by filtration and dried. As a result, compound (3) was obtained with a yield of 21.0 g.

Production of Compound No. 14

2.45 ml of trichloromethyl chloroformate was added to a mixture comprising 21.0 g of compound (3) and 100 ml of tetrahydrofuran in a nitrogen atmosphere at −5° C. to 0° C., and subsequently a solution of 11.2 ml of triethylamine as dissolved in 50 ml of tetrahydrofuran was added thereto. The temperature of the resulting blend was then gradually elevated up to room temperature and then was stirred for 4 hours. Next, the reaction mixture was again cooled, 21.7 g of a compound of:

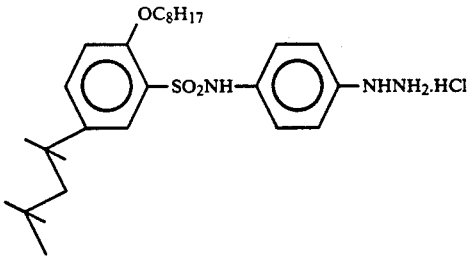

was added thereto and subsequently 5.60 ml of triethylamine was added thereto. The temperature of the resulting blend was then gradually elevated up to room temperature and was stirred for a further 12 hours. The reaction mixture was poured into water and extracted with ethyl acetate. The organic layer was concentrated to dryness. The dry residue obtained was purified by silica gel chromatography to obtain the intended product with a yield of 15.0 g. The chemical structure of the product was identified by NMR spectrum, IR spectrum and elementary analysis.

The compounds of the present invention are used in an amount in the range of from $1\times10^{-6}$ to $5\times10^{-2}$ mol, more preferably from $1\times10^{-5}$ to $1\times10^{-2}$ mol, per mol of silver halide.

The compounds of the present invention can be used in the form of a solution dissolved in appropriate water-miscible organic solvents such as alcohols (e.g., methanol, ethanol, propanol and fluorinated alcohols), ketones (e.g., acetone and methyl ethyl ketone), dimethylformamide, dimethyl sulfoxide or methyl cellosolve.

Using a well-known emulsification and dispersion method, the compounds of the present invention may also be dissolved in an oil such as dibutyl phthalate, tricresyl phosphate, glyceryl triacetate or diethyl phthalate or in an auxiliary solvent such as ethyl acetate or cyclohexanone and thereafter the resulting solution may be formed into an emulsion by mechanical emulsification and dispersion. In addition, a known solid dispersion may be employed in which a powder of a compound of the present invention is dispersed in water by the use of a ball mill or colloid mill or by imparting ultrasonic waves thereto.

The compound represented by the formula (1) or (2) of the present invention is added to a silver halide emulsion layer or other hydrophilic colloid layer. If desired, it may be added to at least one layer of plural silver halide emulsion layers. Some embodiments of constitution of layers of photographic materials to which the compounds of the present invention are added are described below, but the present invention is not limited thereto.

Constitution (1)

A silver halide emulsion layer containing a compound of the present invention and a protective layer are formed on a support. The emulsion layer or the protective layer may further contain an additional hydrazine compound as a nucleating agent.

Constitution (2)

A first silver halide emulsion layer and a second silver halide emulsion layer are formed on a support in order; and the first silver halide emulsion layer or an adjacent hydrophilic colloid layer contains an additional hydrazine compound as a nucleating agent, and the second silver halide emulsion layer or an adjacent hydrophilic colloid layer contains a compound of the present invention.

Constitution (3)

The same as Constitution (2), except that the order of the two emulsion layers is reversed.

In both Constitution (2) and Constitution (3), an interlayer containing a gelatin or a synthetic polymer (e.g., polyvinyl acetate and polyvinyl alcohol) may be provided between the two light-sensitive emulsion layers.

Constitution (4)

A silver halide emulsion layer containing an additional hydrazine compound as a nucleating agent is formed on a support, and a hydrophilic colloid layer containing a compound of the present invention is provided on the emulsion layer or between the support and the emulsion layer.

Especially preferred are Constitution (2) and Constitution (3).

Additional hydrazine compounds which can be employed in the present invention as a nucleating agent are preferably those represented by the following formula (I):

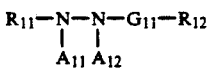

(I)

wherein $R_{11}$ represents an aliphatic group or an aromatic group; $R_{12}$ represents a hydrogen atom, an alkyl group, an aryl group, an alkoxy group, an aryloxy group, an amino group or a hydrazino group; $G_{11}$ represents

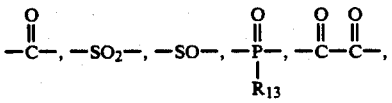

a thiocarbonyl group or an iminomethylene group; $A_{11}$ and $A_{12}$ are both hydrogen atoms, or one represents a hydrogen atom, and the other represents a substituted or unsubstituted alkylsulfonyl group having from 1 to 10 carbon atoms, e.g., a methylsulfonyl group, or a substituted or unsubstituted arylsulfonyl group having from 6 to 10 carbon atoms, e.g., a phenylsulfonyl group, or a substituted or unsubstituted acyl group having from 2 to 10 carbon atoms, e.g., an acetyl group or a benzoyl group; and $R_{13}$ is selected from the range as defined for $R_{12}$, and it may be different from $R_{12}$.

In formula (I), the aliphatic group to be represented by $R_{11}$ is preferably one having from 1 to 30 carbon atoms, and it is especially preferably a linear, branched or cyclic alkyl group having from 1 to 20 carbon atoms. The alkyl group optionally may be substituted.

In formula (I), the aromatic group to be represented by $R_{11}$ is a monocyclic or bicyclic aryl or unsaturated heterocyclic group. The unsaturated heterocyclic group may be condensed with an aryl group to form a condensed unsaturated heterocyclic group.

Preferably, $R_{11}$ is an aryl group; and especially preferably, it is an aryl group containing a benzene ring(s).

The aliphatic group or aromatic group to be represented by $R_{11}$ optionally may be substituted. Typical examples of substituents for the group include an alkyl group, an aralkyl group, an alkenyl group, an alkynyl group, an alkoxy group, an aryl group, a substituted amino group, a ureido group, a urethane group, an aryloxy group, a sulfamoyl group, a carbamoyl group, an alkyl or arylthio group, an alkyl or arylsulfonyl group, an alkyl or arylsulfinyl group, a hydroxyl group, a halogen atom, a cyano group, a sulfone group, an aryloxycarbonyl group, an acyl group, an alkoxycarbonyl group, an acyloxy group, a carbonamido group, a sulfonamido group, a carboxyl group, a phosphorylamido group, a diacylamino group, an imido group, and

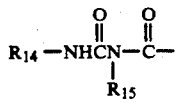

(wherein $R_{14}$ and $R_{15}$ may be selected from the range of $R_2$ and they may be different from each other). Preferred are an alkyl group (preferably having from 1 to 20 carbon atoms), an aralkyl group (preferably having from 7 to 30 carbon atoms), an alkoxy group (preferably having from 1 to. 20 carbon atoms), a substituted amino group (preferably one substituted by alkyl group(s) each having from 1 to 20 carbon atoms), an acylamino group (preferably having from 2 to 30 carbon atoms), a sulfonamido group (preferably having from 1 to 30 carbon atoms), a ureido group (preferably having from 1 to 30 carbon atoms), and a phosphorylamido group (preferably having from 1 to 30 carbon atoms). The groups may further be substituted.

In formula (I), the alkyl group represented by $R_{12}$ is preferably one having from 1 to 4 carbon atoms; and the aryl group represented by the same is preferably a monocyclic or bicyclic aryl group (for example, containing benzene ring(s)). The aryl group, the alkoxy group and the aryloxy group represented by $R_{12}$ are those having not more than 20 carbon atoms, preferably not more than 15 carbon atoms and more preferably not more than 10 carbon atoms.

Where $G_{11}$ is

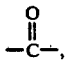

$R_{12}$ is preferably a hydrogen atom, an alkyl group (e.g., methyl, trifluoromethyl, 3-hydroxypropyl, 3-methanesulfonamidopropyl and phenylsulfonylmethyl), an aralkyl group (e.g., o-hydroxybenzyl) or an aryl group (e.g., phenyl, 3,5-dichlorophenyl, o-methanesulfonamidophenyl, 4-methanesulfonylphenyl and 2-hydroxymethylphenyl), and it is especially preferably a hydrogen atom.

$R_{12}$ may optionally be substituted, and examples of substituents for the group $R_{12}$ include those for the above-described group $R_{11}$; .

In formula (I), $G_{11}$ is most preferably

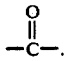

$R_{12}$ may also be a group which has a function of cleaving the moiety of $G_{11}$-$R_{12}$ from the remaining molecule to cause cyclization forming a cyclic structure containing the atoms of the moiety -$G_{11}$-$R_{12}$. Examples of such a group are, for example, those described in JP-A-63-29751.

$A_{11}$and $A_{12}$ are most preferably hydrogen atoms.

In formula (I), $R_{11}$ or $R_{12}$ may contain therein a ballast group, which is ordinarily used in passive (inactive) photographic additives such as couplers, or a polymer residue. Such a ballast group is one having 8 or more carbon atoms which is relatively inactive to photographic properties, and may be selected, for example, from an alkyl group, an alkoxy group, a phenyl group, an alkylphenyl group, a phenoxy group and an alkylphenoxy group. Examples of polymers usable for the purpose are those described in JP-A-1-100530.

In formula (I), $R_{11}$ or $R_{12}$ may contain therein a group having a function of promoting adsorption of the compound of formula (I) to the surfaces of silver halide grains. Examples of such adsorbing promoting groups include a thiourea group, a heterocyclic thioamido group, a mercapto-heterocyclic group, a triazole group and others described in U.S. Pat. Nos. 4,385,108 and 4,459,347, and JP-A-59-195233, JP-A-59-200231, JP-A-59-201045, JP-A-59-201046, JP-A-59-201047, JP-A-59-201048, JP-A-59-201049, JP-A-61-170733, JP-A-61-

270744, JP-A-62-948, JP-A-63-234244, JP-A-63-234245 and JP-A-62-234246.
Specific examples of compounds of formula (I) are shown below, but the present invention is not limited thereto.
I-1
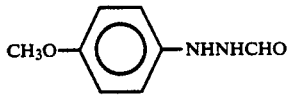
I-2
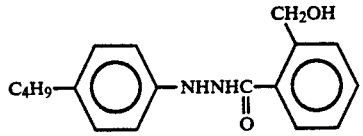
I-3
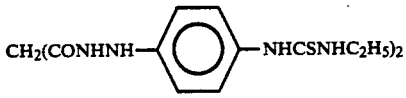
I-4
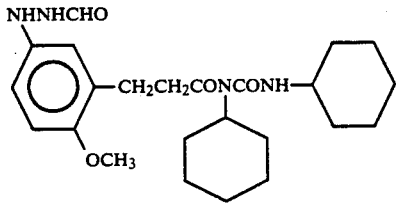
I-5
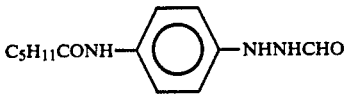
I-6
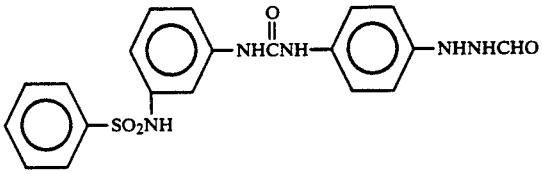
I-7
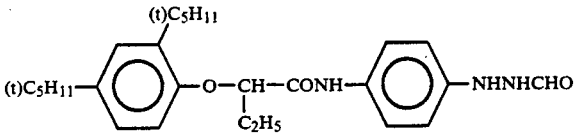
I-8
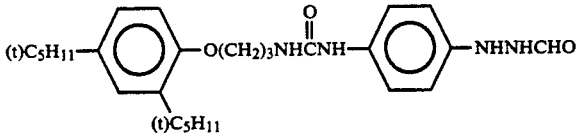
I-9
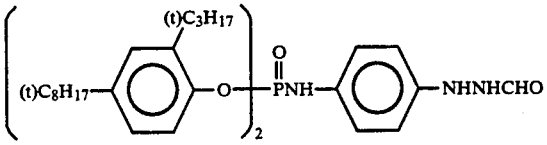
I-10
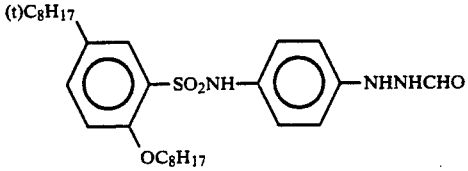

-continued
I-11
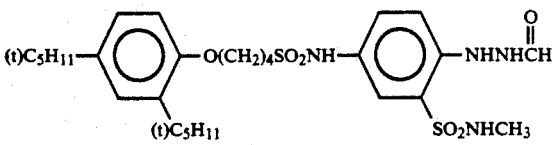
I-12
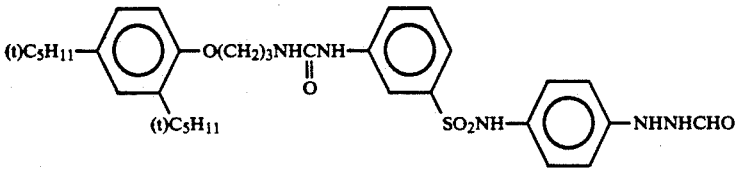
I-13
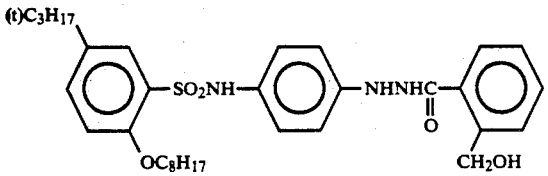
I-14
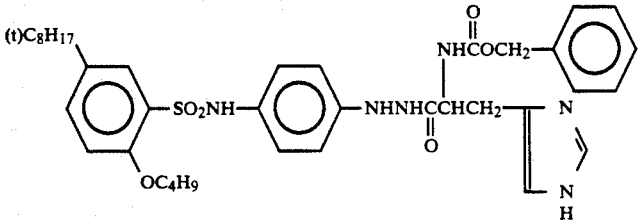
I-15
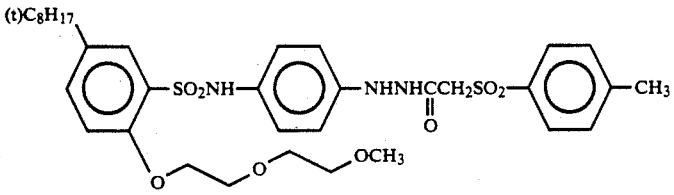
I-16
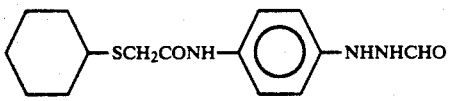
I-17
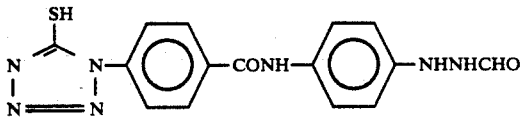
I-18
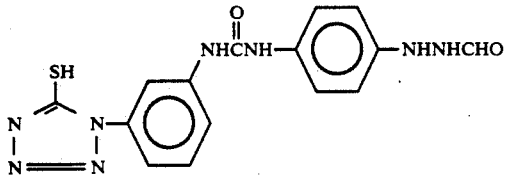

-continued
I-19
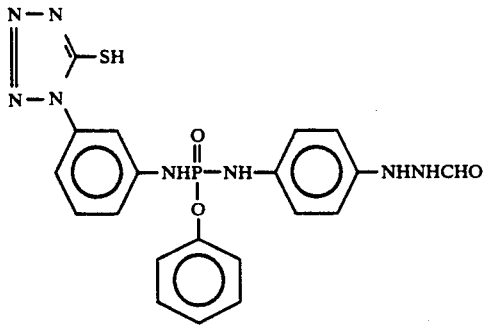
I-20
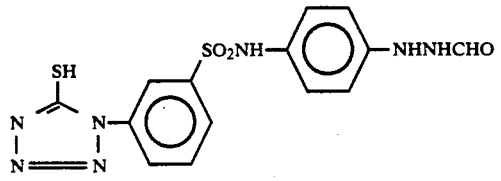
I-21
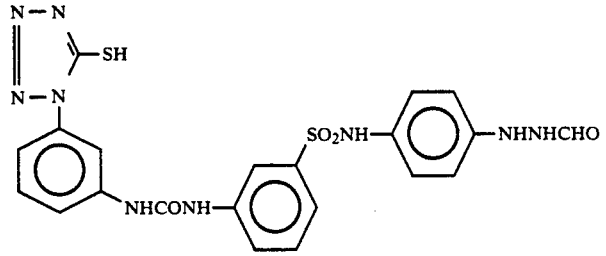
I-22
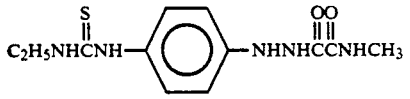
I-23
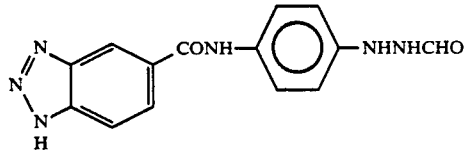
I-24
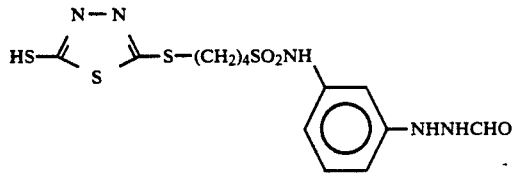
I-25
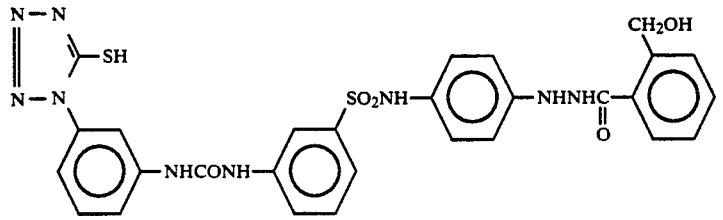

-continued

I-26

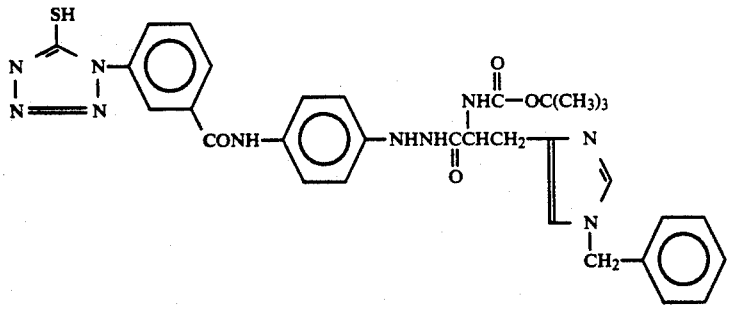

I-27

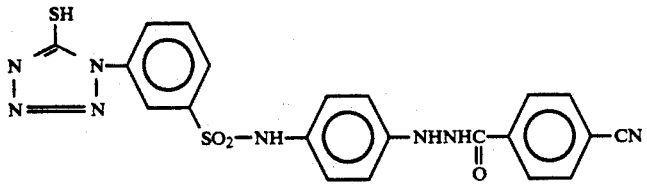

Hydrazine compounds other than those described above, which are useful in the present invention as a nucleating agent include the compounds described in *Research Disclosure,* Item 23516 (November, 1983) and literature as referred to therein, as well as in U.S. Pat. Nos. 4,080,207, 4,169,929, 4,276,364, 4,278,748, 4,385,108, 4,459,347, 3,560,638 and 4,478,928, British Patent 2,011,391B, JP-A-60-179734, JP-A-62-270948, JP-A-63-29751, JP-A-61-1707333, JP-A-61-270744 and JP-A-62-270948, European Patents 217,310 and 356,898, U.S. Pat. No. 4,686,167, JP-A-62-178246, JP-A-63-32538, JP-A-63-104047, JP-A-63-121838, JP-A-63-129337, JP-A-63-223744, JP-A-63-234244, JP-A-63-234245, JP-A-63-234246, JP-A-63-294552, JP-A-63-306438, JP-A-1-100530, JP-A-1-105941, JP-A-1-105943, JP-A-64-10233, JP-A-1-90439, JP-A-1-276128, JP-A-1-280747, JP-A-1-283548, JP-A-1-283549, JP-A-1-285940, JP-A-63-147339, JP-A-63-179760, JP-A-63-229163, JP-A-2-198440, JP-A-2-198441, JP-A-2-198442, JP-A-2-196234, JP-A-2-196235, JP-A-2-220042, JP-A-2-221953, JP-A-2-221954, JP-A-2-302750 and JP-A-2-304550. Methods for preparing the hydrazine compounds represented by formula (1) are also disclosed in these references.

The amount of the hydrazine compound added to the photographic material of the present invention as a nucleating agent is preferably from $1\times10^{-6}$ mol to $5\times10^{-2}$ mol, especially preferably from $1\times10^{-5}$ mol to $2\times10^{-2}$ mol, per mol of silver halide.

For dissolution or dispersion of the nucleating hydrazine compound used in the present invention, the same methods as those described above for dissolving or dispersing redox compounds of formula (1) or (2) may be employed.

Any silver halide of silver chloride, silver bromide, silver chlorobromide, silver iodochloride or silver iodochlorobromide may be used for forming the photographic material of the present invention.

The silver halide grains for use in the present invention are preferably fine grains (for example, having a mean grain size of 0.7 μm or less). Especially, the grains have a mean grain size of 0.5 μm or less. Though the grain size distribution of the grains is basically not limitative, the grains are preferably in the form of a monodispersed emulsion. The "monodispersed emulsion" as referred to herein means that at least 95% by number or by weight of the silver halide grains in the emulsion have a grain size falling within the range of the mean grain size plus/minus 40%.

The silver halide grains in the photographic emulsions constituting the photographic material of the present invention may be regular crystals, such as cubic or octahedral crystals, may be irregular crystals, such as spherical or tabular crystals or composite crystals composed of such various crystal forms.

The silver halide grains may have a uniform phase throughout the whole grain or may have different phases in the inside of the grain and the surface layer thereof. Two or more different silver halide emulsions separately prepared may be blended for use in the present invention.

The silver halide grains used for the photographic material of the present invention can be formed or physically ripened in the presence of a cadmium salt, a sulfite, a lead salt, a thallium salt, a rhodium salt or a complex salt thereof, or an iridium salt or a complex salt thereof.

The emulsion layers and other hydrophilic colloid layers of the photographic material of the present invention can contain various water-soluble dyes, as a filter dye, for the purpose of anti-irradiation or for other various purposes. As filter dyes, usable are dyes that further lower photographic sensitivity, preferably ultraviolet absorbents having a color absorption maximum in the intrinsic sensitivity range of silver halides or dyes having a substantial light absorption essentially in the range of from 350 nm to 600 nm for the purpose of elevating the safety to a safe light where the photographic material is handled as a daylight material.

The dyes are added to the emulsion layers of the photographic material, or they are preferably added to and fixed in an upper layer over the silver halide emulsion layers or a non-light-sensitive hydrophilic colloid layer which is remote from the support with respect to the silver halide emulsion layers, along with a mordant.

The amount of the dye to be added for the purpose may be generally from $10^{-2}$ g/m$^2$ to 1 g/m$^2$, preferably from 50 mg to 500 mg/m$^2$, though varying in accordance with the molar extinction coefficient of the dye.

Specific examples of dyes usable in the present invention are described in JP-A-63-64039, and preferred examples of dyes are shown below.

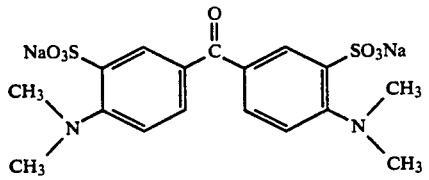

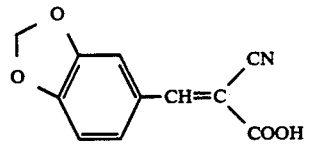

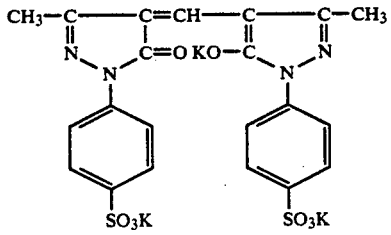

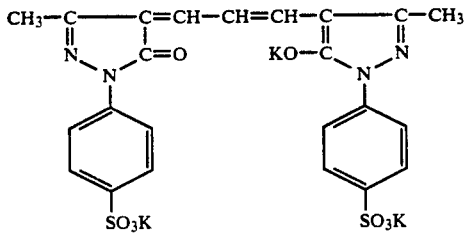

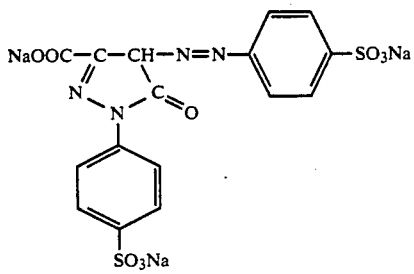

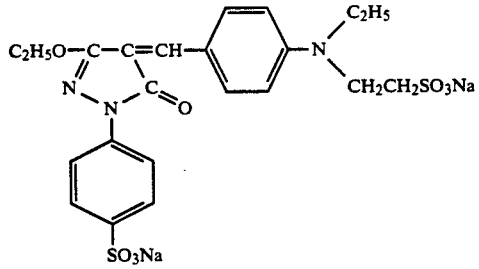

The above dyes may be dissolved in an appropriate solvent (for example, water, alcohols such as methanol, ethanol or propanol, acetone, methyl cellosolve, or a mixed solvent thereof), and the resulting solution may be added to the non-light-sensitive hydrophilic colloid layer-coating composition before preparing the photographic material of the present invention.

Two or more of the dyes may be used in combination.

The dyes may be incorporated into the photographic material of the present invention in such an amount that is sufficient for making the material processable under a daylight condition.

Concretely, the amount of the dye may be generally from $10^{-3}$ g/m$^2$ to 1 g/m$^2$, especially preferably from $10^{-3}$ g/m$^2$ to 0.5 g/m$^2$.

As a binder or protective colloid for photographic emulsions of the photographic material of the present invention, a gelatin is used advantageously, but any other hydrophilic colloids also may be used. For instance, usable are proteins such as gelatin derivatives, graft copolymers of gelatin and other high polymers, albumin and casein; cellulose derivatives such as hydroxyethyl cellulose, carboxymethyl cellulose and cellulose sulfates; saccharide derivatives such as sodium alginate and starch derivatives; and other various synthetic hydrophilic high polymer substances of homopolymers or copolymers such as polyvinyl alcohol, polyvinyl partial acetal, poly-N-vinyl pyrrolidone, polyacrylic acid, polymethacrylic acid, polyacrylamide, polyvinyl imidazole and polyvinyl butyral.

As a gelatin, an acid-processed gelatin also may be used in addition to a lime-processed gelatin. Additionally, a gelatin hydrolysate and an enzyme-decomposed gelatin also may be used.

Silver halide emulsions used for the photographic material of the present invention may be or may not be chemically sensitized. The means of chemical sensitization of silver halide emulsions can be known sulfur sensitization technique, reduction sensitization and noble metal sensitization. Any may be employed singly or in combination of two or more of them for the chemical sensitization of silver halide emulsions for use in the present invention.

Gold sensitization is a typical embodiment of noble metal sensitization, using a gold compound, essentially a gold complex. Complexes of any other noble metals than gold, such as platinum, palladium or iridium, also may be used. Specific examples of usable noble metal complexes are described in, for example, U.S. Pat. No. 2,448,060 and British Patent 618,061.

Examples of sulfur sensitizing agents useful for sulfur sensitization include sulfur compounds contained in gelatin, as well as other various sulfur compounds such as thiosulfates, thioureas, thiazoles and rhodanines.

Examples of reduction sensitizing agents useful for reduction sensitization include stannous salts, amines, formamidinesulfinic acids and silane compounds.

The silver halide emulsion layers of the photographic material of the present invention can contain known color sensitizing dyes.

The photographic material of the present invention can contain various compounds for preventing the materials from fogging during manufacture, storage or photographic processing thereof or for the purpose of stabilizing the photographic properties of the material. For instance, various compounds which are known as an antifoggant or stabilizer can be employed for the purpose and include azoles such as benzothiazolium salts, nitroindazoles, chlorobenzimidazoles, bromobenzimidazoles, mercaptothiazoles, mercaptobenzothiazoles, mercaptothiadiazoles, aminotriazoles, benzothiazoles and nitrobenzotriazoles; mercaptopyrimidines; mercapto triazines; thioketo compounds such as oxazolinethione; azaindenes such as triazaindenes, tetrazaindenes (especially, 4-hydroxy-substituted (1,3,3a,7)-tetrazaindenes), pentazaindenes; as well as benzenethiosulfonic acids, benzenesulfinic acids and benzenesulfonic acid amides. Above all, benzotriazoles (for example, 5-methyl-benzotriazole) and nitroindazoles (for example, 5-nitroindazole) are preferred. The compounds may be added to the processing solutions used for processing the photographic material.

The photographic material of the present invention can contain an inorganic or organic hardening agent in the photographic emulsion layers or other hydrophilic colloid layers. For instance, one or more selected from chromium salts (e.g., chromium alum), aldehydes (e.g., glutaraldehyde), N-methylol compounds (e.g., dimethylolurea), dioxane derivatives, active vinyl compounds (e.g., 1,3,5-triacryloyl-hexahydro-s-triazine and 1,3-vinylsulfonyl-2-propanol), active halogen compounds (e.g., 2,4-dichloro-6-hydroxy-s-triazine) and mucohalogenic acids can be used singly or in combination for the purpose.

The photographic material of the present invention further can contain various surfactants in the photographic emulsion layers or other hydrophilic colloid layers for various purposes such as coating assistance, prevention of static charge, improvement of slide property, emulsification and dispersion, prevention of surface blocking and improvement of photographic characteristics (for example, acceleration of developability, elevation of contrast and enhancement of sensitivity).

For instance, usable for the purpose are nonionic surfactants such as saponins (steroid type), alkylene oxide derivatives (e.g., polyethylene glycol, polyethylene glycol/polypropylene glycol condensates, polyethylene glycol alkyl ethers, polyethylene glycol alkylaryl ethers, polyethylene glycol esters, polyethylene glycol sorbitan esters, polyalkylene glycol alkylamines, polyalkylene glycol alkylamides, and silicone-polyethylene oxide adducts), glycidol derivatives (e.g., alkenylsuccinic acid polyglycerides and alkylphenol polyglycerides), fatty acid esters of polyalcohols and alkyl esters of saccharides; anionic surfactants containing an acid group such as a carboxyl group, a sulfo group, a phospho group, a sulfate group or a phosphate group, for example, alkylcarboxylic acid salts, alkylsulfonic acid salts, alkylbenzenesulfonic acid salts, alkylnaphthalenesulfonic acid salts, alkylsulfate esters, alkylphosphate esters, N-acyl-N-alkyltaurins, sulfosuccinate esters, sulfoalkylpolyoxyethylene alkylphenyl ethers and polyoxyethylene alkylphosphate esters; ampholytic surfactants such as amino acids, aminoalkylphosphonic acids, aminoalkyl sulfate, aminoalkyl phosphate esters, alkylbetaines and amine oxides; and cationic surfactants such as alkylamine salts, aliphatic or aromatic quaternary ammonium salts, heterocyclic quaternary ammonium salts (e.g., pyridinium salts and imidazolium salts) and aliphatic or heterocyclic phosphonium or sulfonium salts.

Surfactants especially preferably used in the present invention are polyalkylene oxides having a molecular weight of 600 or more, as described in JP-B-58-9412. (The term "JP-B" as used herein means an "examined Japanese patent publication".) Additionally, it may further contain a polymer latex such as a polyalkyl acrylate, for improvement of the dimensional stability of the material.

For processing the photographic material of the present invention, the developer used may contain a development accelerator or an accelerator for nucleating infectious development. As the accelerator, effective are compounds described in JP-A-53-77616, JP-A-54-37732, JP-A-53-137133, JP-A-60-140340 and JP-A-60-14959, as well as other various compounds containing N and/or S atoms.

Specific examples of such compounds are shown below.

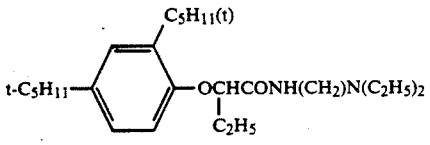

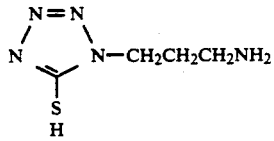

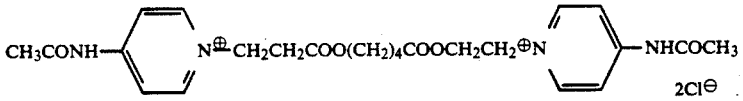

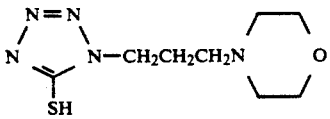

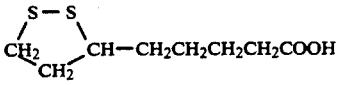

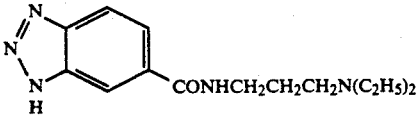

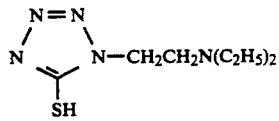

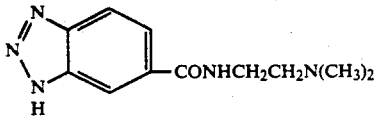

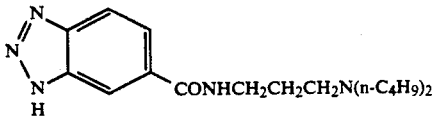

-continued

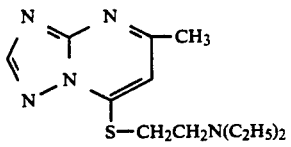

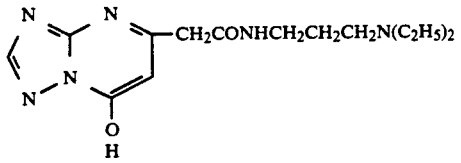

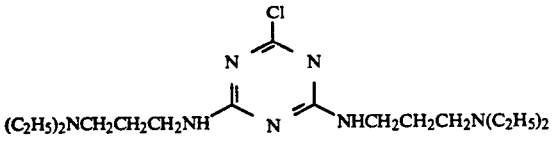

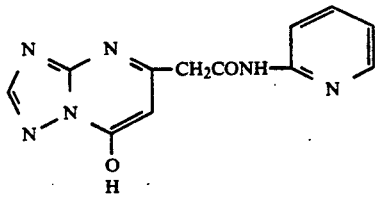

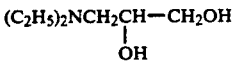

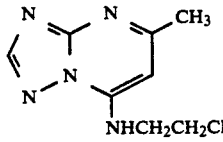

$n\text{-}C_4H_9N(C_2H_4OH)_2$

The optimum amount of the accelerator added to the photographic material of the present invention is, though varying in accordance with the kind of the compound, desirably from $1.0\times10^{-3}$ to 0.5 g/m$^2$, more preferably from $5.0\times10^{-3}$ to 0.1 g/m$^2$. The accelerator may be added to the coating compositions constituting the photographic material of the present invention, in the form of a solution dissolved in an appropriate solvent, such as water, alcohols (e.g., methanol and ethanol), acetone, dimethylformamide or methyl cellosolve.

Plural kinds of additives may be used in combination.

For obtaining ultra-hard photographic images by processing the photographic material of the present invention, known infectious developers or high-alkali developers having a pH value of about 13 as described in U.S. Pat. No. 2,419,975 are unnecessary but any other stable developers can be used.

Specifically, the silver halide photographic material of the present invention may well be processed with a developer containing a sulfite ion as a preservative in an amount of 0.10 mol/liter or more and having a pH value of from 9.0 to 12.3, especially from 10.5 to 12.0, whereby sufficiently ultra-hard negative images can be obtained.

The developing agent in the developer used for processing the photographic material of the present invention is not defined specifically but various compounds as described in T.H. James, *The Theory of the Photographic Process,* 4th Ed. (published by Macmillan Co.), pages 298 to 327 can be used.

For instance, dihydroxybenzenes (e.g., hydroquinone), 3-pyrazolidones (e.g., 1-phenyl-3-pyrazolidone and 4,4-dimethyl-1-phenyl-3-pyrazolidone), aminophenols (e.g., N-methyl-p-aminophenol), ascorbic acid and hydroxylamines can be used singly or in combination.

The silver halide photographic material of the present invention is developed preferably with a developer containing a dihydroxybenzene compound as a main developing agent and a 3-pyrazolidone or aminophenol compound as an auxiliary developing agent. Desirably, in the developer of the type, the content of the dihydroxybenzene compound is from 0.05 to 0.5 mol/liter and that of the pyrazolidone or aminophenol compound is 0.06 mol/liter or less.

Amines may be added to the developer used for processing the photographic material of the present invention for the purpose of accelerating the developing rate and shortening the development time, following the disclosure of U.S. Pat. No. 4,269,929.

The developer may further contain a pH buffer such as alkali metal sulfites, carbonates, borates or phosphates, as well as a development inhibitor or antifoggant such as iodides, bromides or organic antifoggants (especially preferably, nitroindazoles or benzotriazoles). Additionally, it may also contain, if desired, a water softener, a dissolution aid, a toning agent, a development accelerator, a surfactant (especially preferably, the above-mentioned polyalkylene oxides), a defoaming agent, a hardening agent, and an inhibitor for silver stains on films (for example, silver 2-mercaptobenzimidazolesulfonate).

As a fixer used for processing the developed photographic material of the present invention, one having a conventional composition may be used. As the fixing agent, thiosulfates, thiocyanates as well as any other organic sulfur compounds which are known to have an activity as a fixing agent can be used. The fixer may contain a water-soluble aluminium salt or the like as a hardening agent.

The processing temperature in processing the photographic material of the present invention generally can be from 18° C. to 50° C.

An automatic developing machine is preferably employed for processing the photographic material of the present invention. The total processing time of processing the material in an automatic developing machine, which indicates the time necessary from introduction of the material to be processed into the machine to taking out of the finished material from the machine, may be set to fall within the range of from 90 seconds to 120 seconds, whereupon an excellent image having a sufficiently ultra-hard negative gradation can be formed on the processed material.

The developer used for processing the photographic material of the present invention can contain compounds described in JP-A-56-24347 as a silver stain inhibitor. As a dissolution aid which may be added to the developer, compounds described in JP-A-61-267759 can be employed. As a pH buffer which may also be added to the developer, compounds described in JP-A-60-93433 and compounds described in JP-A-62-186259 can be employed.

When the photographic material of the present invention is a color photographic material, the material may comprise at least one blue-sensitive silver halide emulsion layer, at least one green-sensitive silver halide emulsion layer and at least one red-sensitive silver halide emulsion layer on a support. In the material, the number of the silver halide emulsion layers and non-light-sensitive layers as well as the order of the layers on the support is not limited specifically. A typical example is a silver halide color photographic material having plural light-sensitive layer units each composed of plural silver halide emulsion layers each having a substantially same color sensitivity but having a different sensitivity degree. The respective light-sensitive layers are unit light-sensitive layers each having a color-sensitivity to any of blue light, green light and red light. In such a multi-layer silver halide color photographic material, in general, the order of the light-sensitive layer units on the support comprises a red-sensitive layer unit, a green-sensitive layer unit and a blue-sensitive layer unit as formed on the support in that order. As the case may be, however, the order may be opposite to the above-mentioned order, depending on the object of the photographic material. As still another embodiment, a different color-sensitive layer may be sandwiched between other two and the same color-sensitive layers.

Various non-light-sensitive layers such as an interlayer may be provided between the above-mentioned silver halide light-sensitive layers, or on or below the uppermost layer or lowermost layers.

Such an interlayer may contain various couplers and DIR compounds described in JP-A-61-43748, JP-A-59-113438, JP-A-59-113440, JP-A-61-20037 and JP-A-61-20038, and it may also contain conventional color mixing preventing agents.

As the constitution of the plural silver halide emulsions of the respective light-sensitive layer units, preferred is a two-layered constitution composed of a high-sensitivity emulsion layer and a low-sensitivity emulsion layer as described in West German Patent 1,121,470 and British Patent 923,045. In general, it is preferred that the plural light-sensitive layers are arranged on the support in such a way that the sensitivity degree of the layer is to decrease gradually in the direction to the support. In the embodiment, a non-light-sensitive layer may be provided between the plural silver halide emulsion layers. As another embodiment, a low-sensitivity emulsion layer is formed remote from the support and a high-sensitivity emulsion layer is formed near to the support, as described in JP-A-57-112751, JP-A-62-200350, JP-A-62-206541, and JP-A-62-206543.

Specific examples of the layer constitution on the support are mentioned an order of low-sensitivity blue-sensitive layer (BL)/high-sensitivity blue-sensitive layer (BH)/high-sensitivity green-sensitive layer (GH)/low-sensitivity green-sensitive layer (GL)/high-sensitivity red-sensitive layer (RH)/low-sensitivity red-sensitive layer (RL) from the remotest side from the support; an order of BH/BL/GL/GH/RH/RL; and an order of BH/BL/GH/GL/RL/RH.

Other examples are an order of blue-sensitive layer/GH/RH/GL/RL from the remotest side from the support, as described in JP-B-55-34932; and an order of blue-sensitive layer/GL/RL/GH/RH from the remotest side from the support, as described in JP-A-56-25738 and JP-A-62-63936.

A further example is a three-layer unit as described in JP-B-49-15495, where the uppermost layer is a highest-sensitivity silver halide emulsion layer, the intermediate layer is a silver halide emulsion layer having a lower sensitivity than the uppermost layer and the lowermost layer is a silver halide emulsion layer having a further lower sensitivity than the intermediate layer. That is, in the layer constitution of the type, the sensitivity degree of each emulsion layer is lowered gradually to the direction of the support. Even in the three-layer constitution of the type, each of the same color-sensitivity layers may be composed of three layers of middle-sensitivity emulsion layer/high-sensitivity emulsion layer/low-sensitivity emulsion layer as formed in that order from the remotest side from the support, as so described in JP-A-59-202464.

Still other examples of the layer constitution of the photographic material of the present invention are an order of high-sensitivity emulsion layer/low-sensitivity emulsion layer/middle-sensitivity emulsion layer and an order of low-sensitivity emulsion layer/middle-sensitivity emulsion layer/high-sensitivity emulsion layer.

When the photographic material of the invention has four or more layers, the layer constitution thereof may be varied in accordance with the manner described above.

To improve color reproducibility, it is desired to provide a donor layer (CL) which has an interlayer effect and which has a different color sensitivity distribution from that of the essential light-sensitive layers of BL, GL and RL, adjacent to or near the essential light-sensitive layers, in the manner as described in U.S. Pat. Nos. 4,705,744 and 4,707,436 and JP-A-62-160448 and JP-A-63-89850.

As described above, various layer constitutions and arrangements can be selected in accordance with the object of the photographic material of the invention.

When the photographic material of the present invention is a color negative film or color reversal film, the silver halide preferably in the photographic emulsion layer of the material is silver iodobromide, silver iodochloride or silver iodochlorobromide having a silver iodide content of about 30 mol % or less. Especially preferred is a silver iodobromide or silver iodochlorobromide having a silver iodide content of from about 2 mol % to about 25 mol %.

Where the photographic material of the present invention is a color photographic paper, the silver halide contained in the photographic emulsion of the material is preferably silver chlorobromide or silver chloride which is substantially free from silver iodide. The silver halide emulsion which is substantially free from silver iodide as referred to herein means that the emulsion has a silver iodide content of 1 mol % or less, preferably 0.2 mol % or less. The halogen composition of such a silver chlorobromide emulsion may have any desired proportion of silver bromide/silver chloride. The proportion may vary widely in accordance with the object, but preferably the proportion of silver chloride is 2 mol % or more. A so-called high silver chloride emulsion having a high silver chloride content is used preferably in preparing a photographic material suitable for rapid processing. The silver chloride content of such a high silver chloride emulsion is preferably 90 mol % or more, especially preferably 95 mol % or more. For the purpose of reducing the amount of replenisher used in processing the photographic material, an almost pure silver chloride emulsion having a silver chloride content of from 98 to 99.9 mol % also is used preferably.

The silver halide grains in the photographic emulsions of the photographic material of the present invention may be regular crystalline grains such as cubic, octahedral or tetradecahedral grains, irregular crystalline grains such as spherical or tabular grains, irregular crystalline grains having a crystal defect such as a twin plane or composite crystalline grains composed of the above-mentioned regular and irregular crystalline forms.

Regarding the grain size of the silver halide grains, the grains may be fine grains having a small grain size of about 0.2 micron or less or may be large grains having a large grain size of up to about 10 microns as the diameter of the projected area. The emulsion of the grains may be either a polydispersed emulsion or a monodispersed emulsion.

The silver halide photographic emulsions used in the present invention may be prepared by various methods, for example, those described in *Research Disclosure* (RD) No. 17643 (December, 1978), pages 22 to 23 (I. Emulsion Preparation and Types); *RD* No. 18716 (November, 1979), pages 648; P. Glafkides, *Chimie et Physique Photographique* (published by Paul Montel, 1967); G. F. Duffin, *Photographic Emulsion Chemistry* (published by Focal Press, 1966); and V. L. Zelikman et al, *Making and Coating Photographic Emulsion* (published by Focal Press, 1964).

Monodispersed emulsions as described in U.S. Pat. Nos. 3,574,628 and 3,655,394 and British Patent 1,413,748 also are used preferably in the present invention.

Additionally, tabular grains having an aspect ratio of about 5 or more can also be used in the present invention. Such tabular grains can be prepared easily in accordance with the various methods, for example, as described in Gutoff, *Photographic Science and Engineering*, Vol. 14, pages 248 to 257 (1970); U.S. Pat. Nos. 4,434,226, 4,414,310, 4,430,048, 4,439,520 and British Patent 2,112,157.

Regarding the crystal structure of the silver halide grains of the emulsions of the present invention, the grains may have the same halogen composition throughout the whole grain, they may have different halogen compositions between the inside and the outside of one grain, or they may have a layered structure. Further, the grains may have different halogen compositions as conjugated by epitaxial bond, or they may have other components than silver halides, such as silver rhodanide or lead oxide, as conjugated with the silver halide matrix. Additionally, a mixture of various grains of different crystalline forms may be employed in the present invention.

The emulsions for use in the present invention are generally physically ripened, chemically ripened and/or color-sensitized. Additives used in such a ripening or sensitizing step are described in *Research Disclosure* Nos. 17643 and 18716, and the related descriptions in those references are shown in Table A below.

The photographic material of the present invention preferably contains non-light-sensitive fine silver halide grains. Non-light-sensitive fine silver halide grains are meant to be fine silver halide grains which are not sensitive to the light as imparted to the photographic material for imagewise exposure thereof and are substantially not developed in the step of development of the exposed material. The fine grains are desirably not fogged previously.

The fine silver halide grains have a silver bromide content of from 0 to 100 mol % and, if desired, they may contain additionally silver chloride and/or silver iodide. Preferably, they contain silver iodide in an amount of from 0.5 to 10 mol %.

The fine silver halide grains are desired to have a means grain size (as a mean value of the circle-corresponding diameter of the projected area) of from 0.01 to 0.5 μm, more preferably from 0.02 to 0.2 μm.

The fine silver halide grains may be prepared by the same method as that of preparing ordinary light-sensitive silver halide grains. In the case, the surfaces of the fine silver halide grains do not need to be optically sensitized and color sensitization of the grains is unnecessary. However, prior to adding the fine grains to the coating composition, it is desirable to add previously a known stabilizer, such as triazole compounds, azaindene compounds, benzothiazolium compounds, mercapto compounds or zinc compounds, to the coating composition.

Various known photographic additives which may be used in preparing the photographic materials of the present invention are described in the above-mentioned two Research Disclosures, and the related descriptions therein are shown in the following table.

TABLE A

| Kind of Additives | RD 17643 | RD 18716 |
|---|---|---|
| 1. Chemical Sensitizer | p. 23 | p. 648, right column |
| 2. Sensitivity Enhancer | | p. 648, right column |
| 3. Spectral Sensitizer Supercolor Sensitizer | pp. 23 to 24 | p. 648, right column to p. 649, right column |
| 4. Whitening Agent | p. 24 | |
| 5. Anti-foggant Stabilizer | pp. 24 to 25 | p. 649, right column |
| 6. Light-Absorbent Filter Dye Ultraviolet Absorbent | pp. 25 to 26 | p. 649, right column to p. 650, left column |
| 7. Stain Inhibitor | p. 25, right column | p. 650, left to right column |
| 8. Color Image Stabilizer | p. 25 | |
| 9. Hardening Agent | p. 26 | p. 651, left column |
| 10. Binder | p. 26 | p. 651, left column |
| 11. Plasticizer Lubricant | p. 27 | p. 650, right column |
| 12. Coating Aid Surfactant | pp. 26 to 27 | p. 650, right column |
| 13. Antistatic Agent | p. 27 | p. 650, right column |

In order to prevent deterioration of the photographic property of the photographic material of the invention by formaldehyde gas as imparted thereto, compounds capable of reacting with formaldehyde so as to solidify it, for example, those described in U.S. Pat. Nos. 4,411,987 and 4,435,503, are preferably incorporated into the material.

Various color couplers can be incorporated into the photographic material of the present invention, and examples of usable color couplers are described in patent publications as referred to in the above-mentioned RD No. 17643, VII-C to G.

As yellow couplers, for example, those described in U.S. Pat. Nos. 3,933,501, 4,022,620, 4,326,024, 4,401,752 and 4,248,961, JP-B-58-10739, British Patents 1,425,020 and 1,476,760, U.S. Pat. Nos. 3,973,968, 4,314,023 and 4,511,649, and European Patent 249,473A are preferred.

As magenta couplers, 5-pyrazolone compounds and pyrazoloazole compounds are preferred. For instance, those described in U.S. Pat. Nos. 4,310,619 and 4,351,897, European Patent 73,636, U.S. Pat. Nos. 3,061,432 and 3,725,045, RD No. 24220 (June, 1984), JP-A-60-33552, RD No. 24230 (June, 1984), JP-A-60-43659, JP-A-61-72238, JP-A-60-35730, JP-A-55-118034 and JP-A-60-185951, U.S. Pat. Nos. 4,500,630, 4,540,654 and 4,556,630, and WO(PCT)88/04795 are preferred.

As cyan couplers, phenol couplers and naphthol couplers are preferred. For instance, those described in U.S. Pat. Nos. 4,052,212, 4,146,396, 4,228,122, 4,296,200, 2,369,929, 2,801,171, 2,771,162,2,895,816, 3,772,002, 3,758,308, 4,334,011 and 4,327,173, West German Patent (OLS) No. 3,329,729, European Patents 121,365A and 249,453A, U.S. Pat. Nos. 3,446,622, 4,333,999, 4,753,871, 4,451,559, 4,427,767, 4.690,889, 4,254,212 and 4,296,199, and JP-A-61-42658 are preferred.

As colored couplers for correcting the unnecessary absorption of colored dyes, those described in RD No. 17643, U.S. Pat. No. 4,163,670, JP-B-57-39413, U.S. Pat. Nos. 4,004,929 and 4,138,258, and British Patent 1,146,368 are preferred. Additionally, couplers for correcting the unnecessary absorption of the colored dye by the phosphor dye to be released during coupling, as described in U.S. Pat. No. 4,774,181, as well as couplers having a dye precursor group capable of reacting with a developing agent to form dyes, as a split-off group, as described in U.S. Pat. No. 4,777,120 also are used preferably.

Couplers capable of forming colored dyes having a pertinent diffusibility may also be used, and those described in U.S. Pat. No. 4,366,237 British Patent 2,125,570, European Patent 96,570, and West German Patent OLS No. 3,234,533 are preferred.

Polymerized dye-forming couplers also may be used, and typical examples of such couplers are described in U.S Pat. Nos. 3,451,820, 4,080,211, 4,367,282, 4,409,320 and 4,576,910, and British Patent 2,102,137.

Couplers capable of releasing a photographically useful residue along with coupling also may be used in the present invention. For instance, as DIR couplers releasing a development inhibitor, those described in the patent publications as referred to in the above-mentioned RD No. 17643, Item VII-F, as well as those described in JP-A-57-151944, JP-A-57-154234, JP-A-60-184248, JP-A-63-37346 and JP-A-63-37350 and U.S. Pat. Nos. 4,248,962 and 4,7782,012 are preferred.

As couplers that imagewise release a nucleating agent of development accelerator during development, those described in British Patents 2,097,140 and 2,131,188, JP-A-59-157638 and JP-A-59-170840 are preferred.

Additionally, examples of compounds which may be incorporated into the photographic materials of the present invention are competing couplers described in U.S. Pat. No. 4,130,427; polyvalent couplers described in U.S. Pat. Nos. 4,238,472, 4,338,393 and 4,310,618; DIR redox compound-releasing couplers, DIR coupler-releasing couplers, DIR coupler-releasing redox compounds and DIR redox-releasing redox compounds described in JP-A-60-185950 and JP-A-62-24252; couplers releasing a dye which recolors after released from the coupler as described in European Patents 173,302A and 313,308A; bleaching accelerator-releasing couplers as described in RD Nos. 11449 and 24241, and JP-A-61-201247; ligand-releasing couplers described in U.S. Pat. No. 4,553,477; leuco dye-releasing couplers described in JP-A-63-75747; and couplers releasing a phosphor dye as described in U.S. Pat. No. 4,774,181.

The above-mentioned couplers can be incorporated into the photographic materials of the present invention by various known dispersion methods.

For instance, an oil-in-water dispersion method may be employed for the purpose. Examples of high boiling point solvents usable in the method are described in U.S. Pat. No. 2,322,027.

Examples of high boiling point organic solvents having a boiling point of 175° C. or higher at atmospheric pressure, which are used in an oil-in-water dispersion are phthalates (e.g., dibutyl phthalate, dicyclohexyl phthalate, di-2-ethylhexyl phthalate, decyl phthalate, bis(2,4-di-t-amylphenyl) phthalate, bis(2,4-di-t-amylphenyl) isophthalate and bis(1,1-diethylpropyl) phthalate), phosphates or phosphonates (e.g., triphenyl phosphate, tricresyl phosphate, 2-ethylhexyl diphenylphosphate, tricyclohexyl phosphate, tri-2-ethylhexyl phosphate, tridocyl phosphate, tributoxyethyl phosphate, trichloropropyl phosphate and di-2-ethylhexylphenyl phosphonate), benzoates (e.g., 2-ethylhexy benzoate, dodecyl benzoate and 2-ethylhexyl p-hydroxybenzoate), amides (e.g., N,N-diethyldodecanamide, N,N-diethyllaurylamide and N-tetradecylpyrrolidone), alcohols or phenols (e.g., isostearyl alcohol and 2,4-di-tert-amylphenol), aliphatic carboxylates (e.g., bis(2-ethylhexyl) sebacate, dioctyl azelate, glycerol tributylate, isostearyl lactate and trioctyl citrate), aniline derivatives (e.g., N,N-dibutyl-2-butoxy-5-tert-octylaniline) and hydrocarbons (e.g., paraffin, dodecylbenzene and diisopropylnaphthalene). As an auxiliary solvent, organic solvents having a boiling point of approximately from 30 to 160° C., preferably from 50 to 160° C. can be used. Examples of such auxiliary organic solvents are ethyl acetate, butyl acetate, ethyl propionate, methyl ethyl ketone, cyclohexanone, 2-ethoxyethyl acetate and dimethylformamide.

A latex dispersion method also may be employed for incorporating couplers into the photographic material of the present invention. The steps of carrying out the dispersion method, the effect of the method and examples of latexes usable in the method for impregnation are described in U.S. Pat. No. 4,199,363, and West German Patent (OLS) Nos. 2,541,174 and 2,541,130.

If desired, such a coupler is infiltrated into a loadable latex polymer (for example, as described in U.S. Pat. No. 4,203,716) in the presence or absence of the above-mentioned high boiling point organic solvent or is dissolved in a water-insoluble and organic solvent-soluble polymer and is thereafter dispersed in an aqueous hydrophilic colloid solution by emulsification.

Preferably, homopolymers or copolymers as described in International Patent Application Laid-Open No. WO 88/00723, pages 12 to 20 are used for the purpose. In particular, acrylamide polymers are especially preferred in view of stabilization of the color images formed.

The color photographic material of the present invention preferably contains an antiseptic of fungicide of various kinds, for example, selected from those described in JP-A-63-257747, 62-2722248 and 1-80941, such as 1,2-benzisothiazolin-3-one, n-butyl p-hydroxybenzoate, phenol, 4-chloro-3,5-dimethylphenol, 2-phenoxyethanol or 2-(4-thiazolyl)benzimidazole.

The present invention may apply to various color photographic materials, Typical examples of such materials include color negative films for general use or for movie use, as well as color papers, color positive films and color reversal papers.

Suitable supports which are usable in the present invention are described in, for example, the above-mentioned RD No. 17643, page 28, and RD No. 18716, from page 647, right column to page 648, left column.

It is preferred that the total film thickness of all the hydrophilic colloid layers provided on the surface of the support of having emulsion layers is 28 μm or less, preferably 23 μm or less, more preferably 18 μm or less, especially preferably 16 μm or less, in the photographic material of the present invention. It is also preferred that the photographic material of the present invention has a film swelling rate (T ½) of 30 second or less, preferably 20 seconds or less. The film thickness as referred to herein is one as measured under the controlled condition of a temperature of 25° C. and a relative humidity of 55% (for 2 days); and the film swelling rate as referred to herein may be measured by any means in the field. For instance, it may be measured by the use of a swellometer of the model as described in A. Green et al., Photographic Science Engineering, Vol. 19, No. 2, pages 124 to 129. The film swelling rate (T ½) is defined as follows: 90% of the maximum swollen thickness of the photographic material as processed in a color developer under the condition of 30° C. and 3 minutes and 15 seconds is called a saturated swollen thickness. The time necessary for attaining a half (½) of the saturated swollen thickness is defined to be a film swelling rate (T ½).

The film swelling rate (T ½) can be adjusted by adding a hardening agent to gelatin as a binder or by varying the condition of storing the coated photographic material. Additionally, the photographic material of the present invention is desired to have a swelling degree of from 150 to 400%. The swelling degree as referred to herein is calculated from the maximum swollen film thickness as obtained under the above-mentioned condition, on the basis of a formula of:

(maximum swollen film thickness − original film thickness)/(original film thickness).

The color photographic material of the present invention can be developed by any ordinary method, for example, in accordance with the process described in the above-mentioned RD No. 17643, pages 28 and 29, and RD No. 18716, page 615, from left column to right column.

The color developer used for development of the photographic material of the present invention is preferably an aqueous alkaline solution consisting essentially of an aromatic primary amine color-developing agent. As the color-developing agent, p-phenylenediamine compounds are preferably used, though aminophenol compounds are also useful. Specific examples of p-phenylenediamine compounds usable as the color-developing agent include 3-methyl-4-amino-N,N-diethylaniline, 3-methyl-4-amino-N-ethyl-N-β-hydroxyethylaniline, 3-methyl-4-amino-N-ethyl-N-β-methanesulfoneamidoethylaniline and 3-methyl-4-amino-N-ethyl-N-β-methoxyethylaniline, as well as sulfates, hydrochlorides and p-toluenesulfonates of the compounds. Above all, 3-methyl-4-amino-N-ethyl-N-β-hydroxyethylaniline sulfate is especially preferred. The compounds can be used in combination of two or more, in accordance with the object.

The color developer generally contains a pH buffer such as alkali metal carbonates, borates or phosphates, and a development inhibitor or anti-foggant such as bromides, iodides, benzimidazoles, benzothiazoles or mercapto compounds. If desired, it may also contain various preservatives such as hydroxylamine, diethylhydroxylamine, sulfites, hydrazines such as N,N-biscarboxymethylhydrazine, phenylsemicarbazides, triethanolamine and catechol-sulfonic acids; an organic solvent such as ethylene glycol and diethylene glycol; a development accelerator such as benzyl alcohol, polyethylene glycol, quaternary ammonium salts and amines; a dye-forming coupler; a competing coupler; an auxiliary developing agent such as 1-phenyl-3-pyrazolidone; a tackifier; as well as various chelating agents such as aminopolycarboxylic acids, aminopolyphosphonic acids, alkylphosphonic acids and phosphonocarboxylic acids. Specific examples of chelating agents which may be incorporated into the color developer are ethylenediamine-tetraacetic acid, nitrilo-triacetic acid, diethylenetriamine-pentaacetic acid, cyclohexanediaminetetraacetic acid, hydroxylethyliminodiacetic acid, 1-hydroxyethylidene-1,1-diphosphonic acid, nitrilo-N,N,N-trimethylenephosphonic acid, ethylenediamine-N,N,N,N-tetramethylenephosphonic acid, ethylenediaminedi(o-hydroxyphenylacetic acid) and their salts.

Where the photographic material is processed for reversal finish, in general, it is first subjected to black-and-white development and then subjected to color development. For the first black-and-white development, a black-and-white developer which contains a conventional black-and-white developing agent, for example, dihydroxybenzenes such as hydroquinone, 3-pyraozlidones such as 1-phenyl-3-pyraozlidone, or aminophenols such as N-methyl-p-aminophenol, singly or in combination of them, is used.

The color developer and the black-and-white developer generally have a pH value of from 9 to 12. The amount of the replenisher to the developer is, though depending upon the color photographic material to be processed, generally 3 liters or less per $m^2$ of the material to be processed. It may be reduced to 500 ml or less per $m^2$ of the material to be processed by lowering the bromide ion concentration in the replenisher. Where the amount of the replenisher is reduced, it is preferred to reduce the contact area of the surface of the processing solution in the processing tank with air so as to prevent vaporization and air oxidation of the solution.

The contact surface area of the processing solution with air in the processing tank is represented by the opening ratio which is defined by the following formula:

$$\text{Opening Ratio} = \frac{\text{Contact Surface Area (cm}^2\text{) of Processing Solution with Air}}{\text{Volume (cm}^3\text{) of Processing Tank}}$$

The above-described opening ratio is preferably 0.1 or less, more preferably from 0.001 to 0.05. Various means can be employed for the purpose of reducing the opening ratio, which include, for example, provision of a masking substance such as a floating lid on the surface of the processing solution in the processing tank, employment of the mobile lid described in JP-A-1-82033 and employment of the slit-developing method described in JP-A-63-216050. Reduction of the opening ratio is preferably applied to not only both steps of color development and black-and-white development but also all the subsequent steps such as bleaching, bleach-fixation, fixation, rinsing and stabilization steps. In addition, the amount of the replenisher added may also be reduced by means of suppressing accumulation of bromide ions in the developer.

The time for color development is generally within the range of from 2 minutes to 5 minutes, but the processing time may be shortened by elevating the processing temperature, elevating the pH value of the processing solution and elevating the concentration of the processing solution.

After color development, the photographic emulsion layer is generally bleached. Bleaching may be effected simultaneously with fixation (bleach-fixation) or separately therefrom. In order to accelerate processing speed, a system of bleaching followed by bleach-fixation may also be employed. If desired, a system of using a bleach-fixing bath of two continuous tanks, a system of fixation followed by bleach-fixation, or a system of bleach-fixation followed by bleaching may also be employed, in accordance with the object. The bleaching agent can be, for example, compounds of polyvalent metals such as iron(III), as well as peracids, quinones and nitro compounds. Specific examples of the bleaching agent usable in the present invention include organic complexes of iron(III), such as complexes thereof with aminopolycarboxylic acids such as ethylenediaminetetraacetic acid, diethylenetriaminepentaacetic acid, cyclohexanediaminetetraacetic acid, methyliminodiacetic acid, 1,3-diaminopropanetetraacetic acid or glycol ether-diaminetetraacetic acid or with organic acids such as citric acid, tartaric acid or malic acid. Aminopolycarboxylato/iron(III) complexes such as ethylenediaminetetraacetato/iron(III) complex and 1,3-diaminopropanetetraacetato/iron)(III) complex are preferred in view of the rapid processability thereof and prevention of environmental pollution. The aminopolycarboxylato/iron(III) complexes are especially useful both in a bleaching solution and in a bleach-fixing solution. The bleaching solution or bleach-fixing solution containing such aminopolycarboxylato/iron(III) complexes generally has a pH value of from 4.0 to 8, but the solution may have a lower pH value for rapid processing.

The bleaching solution, the bleach-fixing solution and the previous bath may contain a bleaching accelerating agent, if desired. Various bleaching accelerating agents are known, and examples of the agents which are used advantageously in the present invention include mercapto group- or disulfide group-containing compounds described in U.S. Pat. No. 3,893,858, German Patents 1,290,812 and 2,059,988, JP-A-53-32736, JP-A-53-57831, JP-A-53-37418, JP-A-53-72623, JP-A-53-95630, JP-A-53-95631, JP-A-53-104232, JP-A-53-124424, JP-A-53-141623 and JP-A-53-28426, RD No. 17129 (July, 1978); thiazolidine derivatives as described in JP-A-50-140129; thiourea derivatives as described in JP-B-45-8506, JP-A-52-20832 and JP-A-53-32735 and U.S. Pat. No. 3,706,561; iodide salts as described in German Patent 1,127,715 and JP-A-58-16235; polyoxyethylene compounds as described in German Patents 966,410 and 2,748,430; polyamine compounds as described in JP-B-45-8836; other compounds as described in JP-A-49-40943, JP-A-49-59644, JP-A-53-94927, JP-A-54-35727, JP-A-55-26506 and JP-A-58-163940; and bromide ions. Above all, mercapto group- or disulfide group-containing compounds, in particular, those as described in U.S. Pat. No. 3,893,858, German Patent 1,290,812 and JP-A-53-95630 are preferred, as having a large accelerating effect. In addition, compounds described in U.S. Pat. No. 4,552,834 are also preferred. The bleaching accelerators may be incorporated into the photographic material of the invention. Where the material of the invention is a picture-taking color photographic material and it is bleach-fixed, the bleaching accelerators are especially effective.

The bleaching solution and bleach-fixing solution may further contain, in addition to the above-mentioned components, various organic acids for the purpose of preventing bleaching stains. Especially preferred organic acids for the purpose are those having an acid dissociating constant (pKa) of from 2 to 5. For instance, acetic acid, propionic acid and hydroxyacetic acid are preferably used.

As the fixing agent in the fixing solution or bleach-fixing solution applied to the photographic material of the invention, usable are thiosulfates, thiocyanates, thioether compounds, thioureas, and a large amount of iodide salts. Use of thiosulfates is general for the purpose. Above all, ammonium thiosulfate is used most widely. Additionally, a combination of thiosulfates and thiocyanates, thioether compounds or thioureas is also preferred. As the preservative in the fixing solution or bleach-fixing solution, preferred are sulfites, bisulfites and carbonyl-bisulfite adducts, as well as sulfinic acid compounds as described in European Patent 294769A. Further, the fixing solution of bleach-fixing solution may preferably contain various aminopolycarboxylic acids or organic phosphonic acids for the purpose of stabilizing the solution.

The total time for the desilvering process is preferably shorter within the range of not causing desilvering insufficiency. For instance, the time is preferably from 1 minute to 3 minutes, more preferably from 1 minute to 2 minutes. The processing temperature may be from 25° C. to 50° C., preferably from 35° C. to 45° C. In such a preferred temperature range, the desilvering speed is accelerated and generation of stains in the processed material may be prevented effectively.

In the delivering process, it is desired that stirring of the processing solution during the process is promoted as much as possible. Examples of reinforced stirring means for forcedly stirring the photographic material during the desilvering step are a method of running a jet stream of the processing solution to the emulsion-coated surface of the material, as described in JP-A-62-183460; a method of promoting the stirring effect by the use of a rotating means, as described in JP-A-62-183461; a method of moving the photographic material being processed in the processing bath while the emulsion-coated surface of the material is brought into contact with a wiper blade as provided in the processing bath, whereby the processing solution as applied to the emulsion-coated surface of the material is made turbulent and the stirring effect is promoted; and a method of increasing the total circulating amount of the processing solution. Such reinforced stirring means are effective to any of the bleaching solution, bleach-fixing solution and fixing solution. It is considered that reinforcement of stirring of the processing solution would promote penetration of the bleaching agent and fixing agent into the emulsion layer of the photographic material being processed and, as a result, the desilvering rate in processing the material would be elevated. The above-mentioned reinforced stirring means is more effective, when a bleaching accelerator is incorporated into the processing solution. Because of the means, therefore, the bleaching accelerating effect could be augmented remarkably, and the fixation preventing effect by the bleaching accelerator could be avoided.

The photographic material of the present invention can be processed with an automatic developing machine. It is desired that the automatic developing machine used for processing the material of the present invention is equipped with a photographic material-conveying means as described in JP-A-60-191257, JP-A-60-191258 and JP-A-60-191259. As is noted from the related disclosure of JP-A-60-191257, the conveying means may noticeably reduce the carry-over amount from the previous bath to the subsequent bath and therefore it is extremely effective for preventing deterioration of the processing solution being used. Because of the reasons, the conveying means is especially effective for shortening the processing time in each processing step and for reducing the amount of the replenisher to each processing bath.

The silver halide color photographic material of the present invention is generally rinsed in water and/or stabilized, after being delivered. The amount of the water used in the rinsing step can be set in a broad range, in accordance with the characteristic of the photographic material being processed (for example, depending upon the raw material components, such as the coupler and so on) or the use of the material, as well as the temperature of the rinsing water, the number of the rinsing tanks (the number of the rinsing stages), the replenishment system of normal current or countercurrent and other various kinds of conditions. Among the conditions, the relation between the number of the rinsing tanks and the amount of the rinsing water in a multistage countercurrent rinsing system can be obtained by the method described in *Journal of the Society of Motion Picture and Television Engineers,* Vol. 64, pages 248 to 253 (May, 1955).

According to the multistage countercurrent system described in the above-mentioned reference, the amount of the rinsing water used can be reduced noticeably, but because of the prolongation of the residence time of the water in the rinsing tank, bacteria would propagate in the tank so that the floating substances generated by the propagation of bacteria would adhere to the surface of the material as it was processed. Accordingly, the above system would often have a problem. In the practice of processing the photographic material of the present invention, the method of reducing calcium and magnesium ions, which is described in JP-A-62-288838, can be effectively used for overcoming the problem. In addition, isothiazolone compounds and thiabendazoles described in JP-A-57-8542; chlorine-containing bactericides such as chlorinated sodium isocyanurates; and benzotriazoles and other bactericides described in H. Horiguchi, *Chemistry of Bactericidal and Fungicidal Agents* (1986, by Sankyl Publishing Co., Japan), *Bactericidal and Fungicidal Techniques to Microorganisms,* edited by Association of Sanitary Technique, Japan (1982, by Kogyl Gijutsu-kai, Japan), and *Encyclopeadia of Bactericidal and Fungicidal Agents,* edited by Nippon Bactericide and Fungicide Association, Japan (1986), can also be used.

The ph value of the rinsing water used for processing the photographic material of the present invention is from 4 to 9, preferably form 5 to 8. The temperature of the rinsing water and the rinsing time can also be set variously in accordance with the characteristics of the photographic material being processed as well as the use thereof, and in general, the temperature is from 15 to 45° C. and the time is from 20 seconds to 10 minutes, and preferably the temperature is from 25 to 40° C. and the time is from 30 seconds to 5 minutes. Alternatively, the photographic material of the present invention may also be processed directly with a stabilizing solution in place of being rinsed with water. For the stabilization, any known methods, for example, as described in JP-A-57-8543, JP-A-58-14834 and JP-A-60-2203456, can be employed.

In addition, the material can also be stabilized following the rinsing step. One example is a stabilizing bath containing a dye stabilizer and a surfactant, which is used as a final bath for picture-taking color photographic materials. Examples of dye stabilizers usable for the purpose are aldehydes such as formalin and glutaraldehyde, N-methylol compounds, hexamethylenetetramine and aldehyde-sulfite adducts.

The stabilizing bath may also contain various chelating agents and fungicides.

The overflow from the rinsing and/or stabilizing solutions because of addition of replenishers thereto may be re-used in the other steps such as the previous desilvering steps.

Where the photographic material of the present invention is processed with an automatic developing machine system and the processing solutions used in the step are evaporated and thickened, it is desired to add water to the solutions so as to correct the concentration of the solutions.

The silver halide color photographic material of the present invention can contain a color developing agent for the purpose of simplifying and accelerating the processing of the material. For incorporation of a color developing agent into the photographic material, various precursors of the agent are preferably used. For example, indoaniline compounds described in U.S. Pat. No. 3,342,597, Schiff base compounds described in U.S. Pat. No. 3,342,599 and RD Nos. 14850 and 15159, aldole compounds described in RD No. 13924, metal complexes described in U.S. Pat. No. 3,719,492 and urethane compounds described in JP-A-53-135628 can be used as precursors.

The silver halide color photographic material of the present invention can contain various kinds of 1-phenyl-3-pyrazolidones, if desired, for the purpose of accelerating the color developability thereof. Specific examples of these compounds are described in JP-A-56-64339, JP-A-57-144547 and JP-A-58-115438.

The processing solutions for the photographic material of the invention are used at 10° C. to 50° C. In general, a processing temperature of from 33° C. to 38° C. is standard, but the temperature may be made higher so as to accelerate the processing or to shorten the processing time, or on the contrary, the temperature may be made lower so as to improve the quality of images formed and to improve the stability of the processing solution used.

The compounds of the present invention are also usable in heat-developing photographic materials. Details of heat-developing photographic materials are described in, for example, U.S. Pat. Nos. 4,463,079, 4,474,867, 4,478,927, 4,507,380, 4,500,626 and 4,483,914, JP-A-58-149046, JP-A-58-149047, JP-A-59-152440, JP-A-59-154445, JP-A-59-165054, JP-A-59-180548, JP-A-59-168439, JP-A-59-174832, JP-A-59-174833, JP-A-59-174834, JP-A-59-174835, JP-A-61-232451, JP-A-62-65038, JP-A-62-253159, JP-A-63-316848 and JP-A-64-13546, and European Patent Publication Nos. 210,660A2 and 220,746A2.

The known heat-developing photographic materials basically have light-sensitive silver halides, binders, dye-providing compounds reducing agents (as the case maybe, dye-providing substances may act also as a reducing agent) on a support and, if desired, they may contain other additives such as organic silver salts.

The heat-developing photographic material of the type may be either one to form a negative image by exposure or one to form a positive image by exposure. The latter case of forming a positive image may be either one containing a direct positive emulsion as a silver halide emulsion (which may be either in the form of a nucleating agent-containing system or in the form of a fogged system) or one containing a dye-providing compound capable of releasing a positive diffusive dye image.

There are known various systems of transferring a diffusive dye, which are, for example, a system of transferring a dye onto a dye-fixing layer by means of an image-forming solvent such as water, a system of transferring dye onto a dye-fixing layer by means of a high boiling point organic solvent, a system of transferring a dye onto a dye-fixing layer by means of a hydrophilic hot-melting solvent, and a system of transferring a diffusive dye onto a dye-fixing layer having a dye-receiving polymer by the action of the thermal diffusibility or sublimiability of the dye. Any one of such systems may be employed in the present invention.

As the above-described image-forming solvent, water is known, which is not limited to only a pure water but includes any and every conventional water. In addition, a mixed solvent comprising a pure water and a low boiling point solvent such as methanol, dimethylformamide (DMF), acetone or diisobutyl ketone may also be employed. Further, the solvent may also be in the form of a solution containing an image formation accelerator, an anti-foggant, a development stopper and a hydrophilic hot-melting solvent.

The present invention is described in more detail by way of the following examples, which, however, are not intended to limit the scope of the present invention.

EXAMPLE 1

Preparation of First Light-Sensitive Emulsion Layer

An aqueous 0.13 M silver nitrate solution and an aqueous halide solution containing $1\times10^{-7}$ mol per mol of silver of $(NH_4)_3RhCl_6$, $2\times10^{7}$ mol per mol of silver of $K_3IrCl_6$, 0.04 M of potassium bromide and 0.09 M of sodium chloride were added to an aqueous gelatin solution containing sodium chloride and 1,3-dimethyl-2-imidazolidinethione, with stirring at 38° C. over a period of 12 minutes by a double-jet method, to effect nucleation of obtaining silver chlorobromide grains having a mean grain size of 0.15 μm and a silver chloride content of 70 mol %. Subsequently, an aqueous 0.87 M silver nitrate solution and an aqueous halide solution containing 0.26 M of potassium bromide and 0.65 M of sodium chloride were added thereto in the same manner by a double-jet method over a period of 20 minutes. Next, $1\times10^{-3}$ mol of a KI solution was added thereto for effecting conversion, and the resulting emulsion was washed with water by means of a conventional flocculation method. 40 g of gelatin was added to the thus washed emulsion which was then adjusted to have a pH of 6.5 and a pAg of 7.5. Further, 5 mg of sodium thiosulfate per mol of silver and 8 mg of chloroauric acid per mol of silver were added to the emulsion, which was then heated at 60° C. for 60 minutes for effecting chemical sensitization. 150 mg of 1,3,3a,7-tetrazaindene was added thereto as a stabilizer. The grains thus formed were cubic silver chlorobromide grains having a mean grain size of 0.28 μm and a silver chloride content of 70 mol %. (The fluctuation coefficient was 10%.) The emulsion thus prepared was divided into plural parts. $1\times10^{-3}$ mol of 5-[3-(4-sulfobutyl)-5chloro-2-oxazolidylidene]-1hydroxyethyl-3-(2-pyridyl)-2-thiohydantoin per mol of silver was added thereto as a sensitizing dye, and $2\times10^{-4}$ mol of 1-phenyl-5mercaptotetrazole per mole of silver, $5\times10^{-4}$ mol per mol of silver of a short-wave cyanine dye having the following structural formula (a), 200 mg/m² of a polymer of the following formula (b), 200 mg/m² of a dispersion of polyethyl acrylate, 200 mg/m² of 1,3-divinyl-sulfonyl-2-propanol as a hardening agent, and $2.8\times10^{5}$ mol/m² of a hydrazine compound of the following formula (c) as a nucleating agent were added thereto.

The resulting emulsion was coated on a polyethylene terephthalate support having a thickness of 100 μm having provided thereon a subbing layer, in an amount of 3.6 g/m² as a silver coverage.

Compound (a):

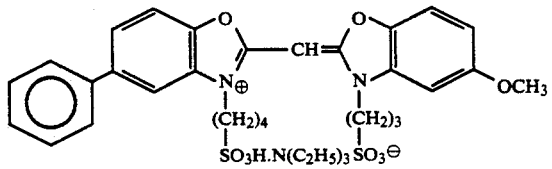

Compound (b):

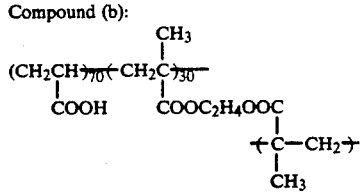

Hydrazine Compound (c):

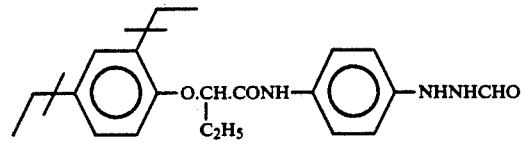

Coating of Interlayer

An interlayer comprising the following composition was coated over the first light-sensitive emulsion layer.

| | |
|---|---|
| gelatin | 1.0 g/m² |
| 1,3-bisvinylsulfonyl-2-propanol | 4.0 wt. % to gelatin |

Preparation of Second Light-Sensitive Emulsion Layer

Preparation of Light-Sensitive Emulsion (B)

An aqueous silver nitrate solution and an aqueous solution containing potassium iodide and potassium bromide were added simultaneously to an aqueous gelatin solution kept at 50° C., in the presence of $4\times10^{-7}$ mol of potassium iridium(III) hexachloride per mol of silver and ammonia, over a period of 60 minutes, which keeping the pAg value of the reaction system at 7.8 to prepare a cubic monodispersed emulsion having a mean grain size of 0.28 μm and a means silver iodide content of 0.3 mol %. The emulsion was desalted by means of a flocculation method, and then 40 g of an inert gelatin per mol of silver was added thereto. Then, the emulsion was kept at 50° C. and then added to a mixture comprising a sensitizing dye of 5,5'-dichloro-9-ethyl-3,3'-bis(3-sulfopropyl)oxacarbocyanine and $10^{-3}$ mol of a KI solution per mol of silver, and the resulting mixture was kept as it was for 15 minutes and then cooled. Thus, a light-sensitive emulsion (B) was prepared.

Coating of Second Light-Sensitive Emulsion Layer

The light-sensitive emulsion (B) prepared above was re-dissolved, and the following chemicals were added thereto at 40° C. The resulting composition was then coated over the interlayer in an amount of 0.4 g/m² as silver and 0.5 g/m² as gelatin.

| | |
|---|---|
| 5-Methylbenzotriazole | $5.0\times10^{-3}$ mol/mol of Ag |
| 6-Methyl-4-hydroxy-1,3,3a,7-tetrazaindene | $2\times10^{-3}$ mol/mol of Ag |
| Polyethyl Acrylate | 30 wt. % to gelatin |
| 1,3-Bisvinylsulfonyl-2-propanol | 4.0 wt. % to gelatin |
| Redox compound (shown in Table 1) | $2.0\times10^{-5}$ mol/m² |

Coating of Protective Layer

Over a second light-sensitive emulsion layer was coated a protective layer comprising 1.5 g/m² of gelatin and 0.3 g/m² of polymethyl methacrylate grains (having a mean grain size of 2.5 μm) along with the following surfactants.

Surfactants Used

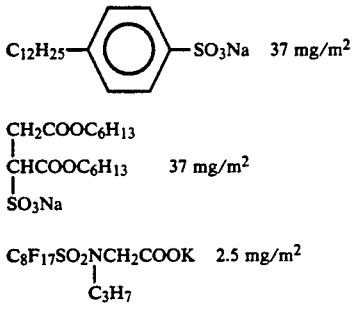

Samples thus prepared were exposed with a tungsten light of 3200° K. through an optical wedge and a contact screen (150L Chain-Dot Model, produced by Fuji Photo Film Co., Ltd.) and then developed with the following Developer (A) at 34° C. for 30 seconds, fixed rinsed with water and dried.

The thus processed samples were evaluated with respect to the dot gradation and halftone dot quality thereof. Dot gradation is represented by the following formula:

Dot Gradation =

[exposure amount of giving 95% dot area (log*E* 95%)] −

[exposure amount of giving 5% dot area (log*e* 5%)]

Halftone dot quality was evaluated visually by five ranks, in which "5" is the best and "1" is the worst. The ranks "5" and "4" mean to be practical as a halftone plate for photomechanical process; the rank "3" means to be the limit for practical use; and the ranks "2" and "1" mean to be impractical.

| Developer (A) | |
|---|---|
| Hydroquinone | 50.0 g |
| N-methyl-p-aminophenol | 0.3 |
| Sodium Hydroxide | 18.0 |
| 5-Sulfosalicylic Acid | 55.0 |
| Potassium Sulfite | 110.0 |
| Disodium Ethylenediaminetetraacetate | 1.0 |
| Potassium Bromide | 10.0 |
| 5-Methylbenzotriazole | 0.4 |
| 2-Mercaptobenzimidazole-5-sulfonic Acid | 0.3 |
| Sodium 3-(5-Mercaptotetrazole)-benzene-sulfonate | 0.2 |
| N-n-Butyldiethanolamine | 15.0 |
| Sodium Toluenesulfonate | 8.0 |
| Water to make | 1 liter |
| pH adjusted with potassium hydroxide to | 11.6 |

TABLE 1

| Sample No. | Redox Compound | Dot Gradation (ΔlogE) | Halftone Dot Quality |
|---|---|---|---|
| 1 Comparative Sample, 1-a | — | 1.23 | 3 |
| 2 Comparative Sample, 1-b | Comparative Compound A | 1.30 | 4 |
| 3 Comparative Sample, 1-c | Comparative Compound B | 1.21 | 3 |
| 4 Comparative Sample, 1-d | Comparative Compound C | 1.27 | 3 |
| 5 Comparative Sample, 1-e | Comparative Compound D | 1.25 | 3 |
| 6 Comparative Sample, 1-f | Comparative Compound E | 1.45 | 5 |
| 7 Sample of Invention, 1-1 | Compound 1 | 1.45 | 5 |
| 8 Sample of Invention, 1-2 | Compound 3 | 1.45 | 5 |
| 9 Sample of Invention, 1-3 | Compound 4 | 1.53 | 5 |
| 10 Sample of Invention, 1-4 | Compound 5 | 1.54 | 5 |
| 11 Sample of Invention, 1-5 | Compound 6 | 1.52 | 5 |
| 12 Sample of Invention, 1-6 | Compound 8 | 1.48 | 5 |
| 13 Sample of Invention, 1-7 | Compound 11 | 1.50 | 5 |
| 14 Sample of Invention, 1-8 | Compound 13 | 1.51 | 5 |
| 15 Sample of Invention, 1-9 | Compound 14 | 1.50 | 5 |
| 16 Sample of Invention, 1-10 | Compound 33 | 1.45 | 5 |

Comparative compounds used above are as follows:

Comparative Compound (A)

Compound No. 28 described in JP-A-61-213847.

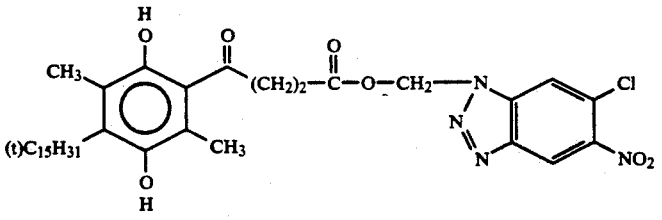

Comparative Compound (B)

Compound No. 2 described in JP-A-62-260153.

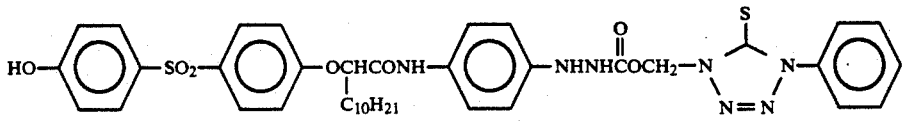

Comparative Compound (C)

Compound No. 10 described in JP-A-64-88451.

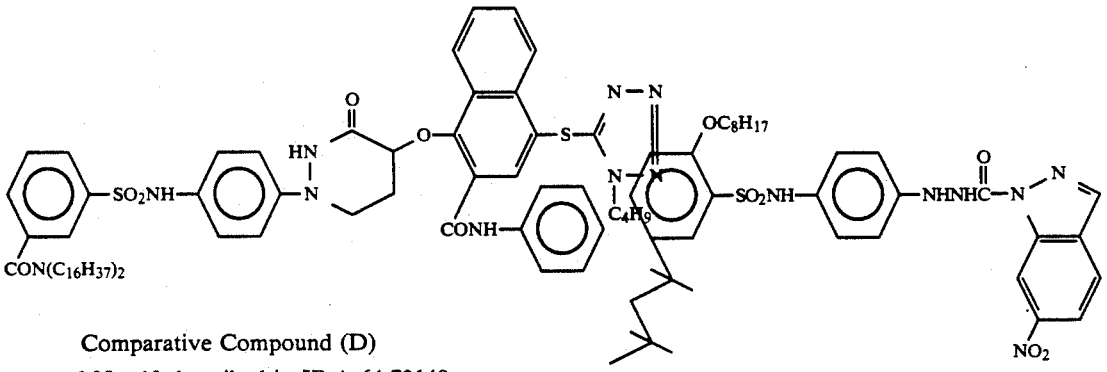

Comparative Compound (D)

Compound No. 13 described in JP-A-64-72140.

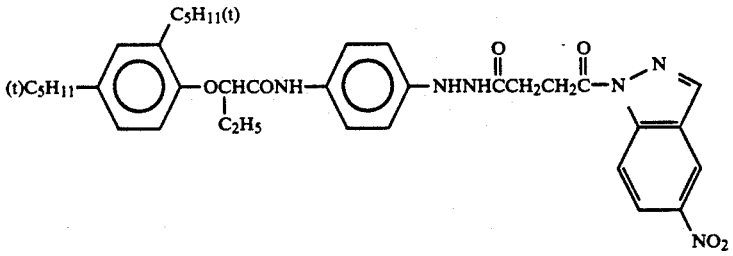

Comparative Compound (E)

This is described in prior Japanese Patent Application No. 2-62337.

As is obvious from the results in Table 1 above, all the samples of the present invention and Comparative Sample (1-f) had a broad halftone gradation latitude and a high halftone dot quality.

EXAMPLE 2

A large number of sheets of each of 16 samples of Example 1 were developed in accordance with the condition mentioned below, to prepare 16 kinds of fatigued developers (B-1) to (B-16), respectively.

Processing Condition 20 liters of Developer (A) was kept at 34° C. Each sample sheet having a size of 50.8 cm×60 cm was exposed to have a blackened density of 80%. Each of the thus exposed sheets were developed with the developer in an amount of 200 sheets a day, whereupon the development time for all sheets was 30 seconds. Thus, 16 kinds of fatigued developers were prepared.

A fresh Developer (A) and the thus fatigued 16 developers were used. Each sample was exposed in the same manner as in Example 1 and then developed with the fresh developer and the fatigued developer. The difference in the photographic sensitivity between the sample as processed with the fresh developer and that processed with the fatigued developer ($\Delta\log E_1$) was obtained and shown in Table 2 below. The photographic density (log E) is a logarithmic number of the amount of exposure necessary for giving a density of 1.5.

Next, a commercial film of GRANDEX Film GA100 (product by Fuji Photo Film Co.) was exposed in the same manner as in Example 1 and then developed with the fresh developer (A) and with each of the fatigued developers (B-1) to (B-16). The difference in the photographic sensitivity between the commercial film sample as processed with the fresh developers (B-1) to (B-16) ($\Delta\log E_2$) was obtained and shown in Table 2 below.

From the results in Table 2, it is understood that the fluctuation of the photographic sensitivity of each of the samples of the present invention is far smaller than that of the comparative samples (2-b) to (2-f). The level of the fluctuation of the photographic sensitivity of each of the samples of the present invention is almost the same as that of the comparative sample (2-a) containing no redox compound.

TABLE 2

| Sample No. | Fatigued Developer | Fluctuation of Photographic Sensitivity of Sample as Processed with Fatigued Developer: Indicated Sample ($\Delta\log E_1$) | GRANDEX Film GA-100 ($\Delta\log E_2$) |
|---|---|---|---|
| 1 Comparative Sample, 2-a | B1 | −0.05 | −0.08 |
| 2 Comparative Sample, 2-b | B2 | −0.29 | −0.33 |
| 3 Comparative Sample, 2-c | B3 | −0.25 | −0.27 |
| 4 Comparative Sample, 2-d | B4 | −0.24 | −0.25 |
| 5 Comparative Sample, 2-e | B5 | −0.36 | −0.39 |
| 6 Comparative Sample, 2-f | B6 | −0.35 | −0.35 |
| 7 Sample of Invention, 2-1 | B7 | −0.07 | −0.10 |
| 8 Sample of Invention, 2-2 | B8 | −0.06 | −0.11 |
| 9 Sample of Invention, 2-3 | B9 | −0.08 | −0.12 |
| 10 ample of Invention, 2-4 | B10 | −0.08 | −0.13 |
| 11 Sample of Invention, 2-5 | B11 | −0.08 | −0.12 |
| 12 Sample of Invention, 2-6 | B12 | −0.06 | −0.11 |
| 13 Sample of Invention, 2-7 | B13 | −0.07 | −0.10 |
| 14 Sample of Invention, 2-8 | B14 | −0.09 | −0.14 |
| 15 Sample of Invention, 2-9 | B15 | −0.06 | −0.10 |
| 16 Sample of Invention, 2-10 | B16 | −0.05 | −0.09 |

EXAMPLE 3

Preparation of Light-Sensitive Emulsion (B)

An aqueous silver nitrate solution and an aqueous sodium chloride solution were added simultaneously to an aqueous gelating solution kept at 50° C., in the presence of $5.0\times10^{-6}$ mol of $(NH_4)_3RhCl_6$ per mole of silver, and then soluble slats were removed from the reaction system by a conventional method well known in the technical field. Gelatin was added thereto and, without chemical ripening of the emulsion, a stabilizer of 6-methyl-4-hydroxy-1,3,3a,7-tetrazaindene was added thereto. The thus prepared emulsion was a monodispersed emulsion of cubic grains having a mean grain size of 0.15 μm.

Coating of Light-Sensitive Emulsion Layers

First Layer

To the emulsion (B) were added a nucleating agent of Hydrazine Compound I-8 (75 mg/m²), 5-methylbenzotriazole ($5\times10^{-3}$ mol/mol of Ag), polyethyl acrylate latex (30 wt. % to gelatin) and 1,3-divinylsulfonyl-2-propanol (2.0 wt. % to gelatin). The resulting composition was coated on a support in an amount of 3.5 g/m² as silver.

Second Layer

Gelatin (1.0 g/m²) was coated.

Third Layer

To the emulsion (B) were added 5-methylbenzotriazole ($5\times10^{-3}$ mol/mol of Ag), polyethyl acrylate latex (30 wt. % to gelatin), 1,3-divinylsulfonyl-2-propanol (2 wt. % to gelatin), 1,3-divinylsulfonyl-2-propanol (2 wt. % to gelatin) and redox compound (shown in Table 3 below). The resulting composition was coated in an amount of 0.4 g/m² as silver.

Fourth Layer (Protective Layer)

A protective layer comprising 1.5 g/m² of gelatin, 0.3 g/m² of a mat agent of polyethyl methacrylate grains (having a mean grain size of 2.5 μM) and, as coating aids, the following surfactants, stabilizer and ultraviolet absorbing dye, was coated and dried.

Surfactants

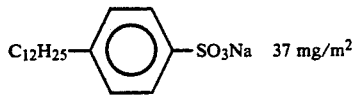

37 mg/m²

-continued

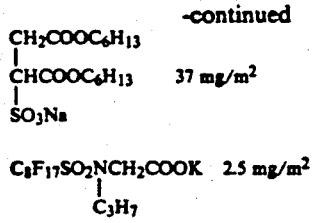

Stabilizer

Thioctic Acid

Ultraviolet Absorbent

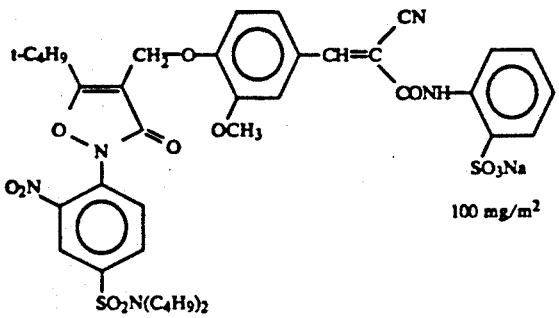

The thus prepared samples were imagewise exposed through the original shown in FIGURE by the use of a daylight printer P-607 Model (manufactured by Dai-Nippon Screen Co.) and then developed at 38° C. for 20 seconds, fixed, rinsed with water and dried. The thus processed samples were evaluated with respect to the quality of the superimposed letter image formed thereon by way of 5-rank evaluation.

For the 5-rank superimposed letter image evaluation, the photographic material sample was properly exposed through the original of FIGURE so that 50% of the dot area of the original could be 50% of the dot area of the reproduced image on the sample by contact dot-to-dot work. The rank "5" in the evaluation indicates that 30 micron-letters were well reproduced under the condition and the superimposed letter image quality was excellent. The rank "1" therein indicates that only letters of 150 microns or more were reproduced under the same condition and the superimposed letter image quality was bad. The other ranking of from "4" to "2" between the ranks "5" and "1" was conducted by functional evaluation. The ranks "3" or more indicate the practical level.

The results obtained are shown in Table 3 below. As is obvious therefrom, the samples of the present invention had an excellent superimposed letter image quality.

In addition, the samples were tested with respect to the photographic property as processed with a fatigued developer in the same manner as in Example 2. As a result, all the samples of the present invention gave good results, like those in Example 2.

TABLE 3

| Sample | Redox Compound Kind | Redox Compound Amount Added (mol/m²) | Super-Imposed Letter Image Quality |
|---|---|---|---|
| Comparative Sample, No. 6 | Comparative Compound B | $2.0 \times 10^{-5}$ | 3 |
| Sample of Invention, No. 3-1 | Compound 1 | $2.0 \times 10^{-5}$ | 4 |
| Sample of Invention, No. 3-2 | Compound 3 | $2.0 \times 10^{-5}$ | 4 |
| Sample of Invention, No. 3-3 | Compound 4 | $2.0 \times 10^{-5}$ | 5 |
| Sample of Invention, No. 3-4 | Compound 5 | $2.0 \times 10^{-5}$ | 5 |
| Sample of Invention, No. 3-5 | Compound 6 | $2.0 \times 10^{-5}$ | 5 |
| Sample of Invention, No. 3-6 | Compound 8 | $2.0 \times 10^{-5}$ | 5 |

EXAMPLE 4

Samples of the Invention, 4-1 to 4-7 were prepared in the same manner as Sample 1-1 described in Example 1 except for using each of the hydrazine compounds of formula (I) shown in Table 4 below in place of Hydrazine Compound (c) used in Example 1.

The resulting samples were evaluated with respect to the dot gradation, and the halftone dot quality in the same manner as in Example 1 as well as the photographic sensitivity when developed with a fatigued developer in the same manner as in Example 2. The results obtained are shown in Table 4 below.

TABLE 4

| Sample No. | Hydrazine Compound of Formula (I) Compound No. | Hydrazine Compound of Formula (I) Amount Added (mol/m²) | Dot Gradation (ΔlogE) | Halftone Dot Quality | Fluctuation in Photographic Sensitivity as Processed with Fatigued Developer |
|---|---|---|---|---|---|
| 1 Sample of Invention, 4-1 | I-2 | $2.8 \times 10^{-5}$ | 1.38 | 5 | −0.11 |
| 2 Sample of Invention, 4-2 | I-10 | $2.8 \times 10^{-5}$ | 1.45 | 5 | −0.08 |
| 3 Sample of Invention, 4-3 | I-13 | $2.8 \times 10^{-5}$ | 1.48 | 5 | −0.07 |
| 4 Sample of Invention, 4-4 | I-22 | $2.8 \times 10^{-5}$ | 1.39 | 5 | −0.10 |
| 5 Sample of Invention, 4-5 | I-20 | $4.0 \times 10^{-6}$ | 1.47 | 5 | −0.06 |
| 6 Sample of Invention, 4-6 | I-25 | $4.0 \times 10^{-6}$ | 1.50 | 5 | −0.07 |
| 7 Sample of Invention, 4-7 | I-27 | $4.0 \times 10^{-6}$ | 1.48 | 5 | −0.08 |

It is understood from the results shown in Table 4 that excellent photographic having a broad dot gradation, good halftone quality and less fluctuation in photographic sensitivity when developed with a fatigued developer can be obtained by using a hydrazine compound represented by formula (I) of the present invention.

While the invention has been described in detail and with reference to specific embodiments thereof, it will be apparent to one skilled in the art that various changes and modifications can be made therein without departing from the spirit and scope thereof.

What is claimed is:

1. A silver halide photographic material comprising a compound of general formula (2):

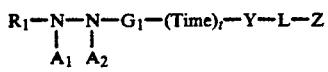

(2)

wherein time is a divalent linking group; t represents 0 or 1; Y-L-Z is a development inhibitor, wherein Y is a divalent group comprising a hetero atom through which Y bonds to the moiety

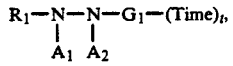

L is a divalent group which is capable of being cleaved by a component of a developer and Z is a functional group that expresses a development inhibiting effect wherein, after cleavage of L, a resulting compound of Y-L-Z has a small development inhibiting activity; $R_1$ is an aliphatic group or an aromatic group; $G_1$ is

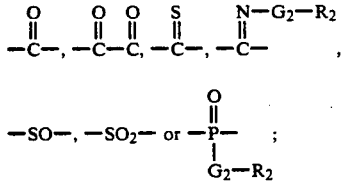

$G_2$ is a mere bond, —O—, —S— or

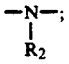

$R_2$ has the same meaning as $R_1$ or is a hydrogen atom; when said compound has plural $R_2$'s they are the same or different; and one of $A_1$ and $A_2$ is a hydrogen atom and the other is a hydrogen atom, an acyl group, an alkylsulfonyl group or an arylsulfonyl group; and a hydrazine compound represented by the formula (I):

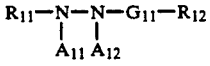

(I)

wherein $R_{11}$ is an aliphatic group or an aromatic group; $R_{12}$ is a hydrogen atom, an alkyl group, an aryl group, an alkoxy group, an aryloxy group, an amino group or a hydrazino group; $G_{11}$ is

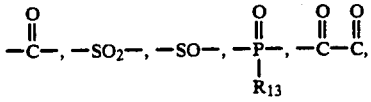

a thiocarbonyl group or an iminomethylene group; $A_{11}$ and $A_{12}$ are both hydrogen atoms, or one is a hydrogen atom, and the other is an alkylsulfonyl group, an arylsulfonyl group or an acyl group; and $R_{13}$ has the same meaning as $R_{12}$, and $R_{13}$ is the same as or different from $R_{12}$.

2. The silver halide photographic material of claim 1, wherein the moiety -Y-L-Z in formula (2) is represented by formula (3):

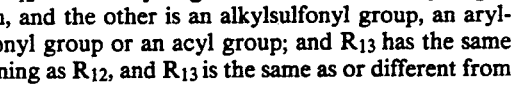

(3)

wherein $R_1$ is —O—, —S—, -Se-, -Te- or

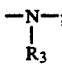

$R_3$ is a hydrogen atom or has the same meaning as $R_1$ in the formula (2); $Y_2$ is an aliphatic group, an aromatic group, or a substituted divalent group formed by combining an aliphatic or aromatic group and —O—, —S—, -Se-,

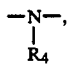

—CO—, —SO— or —$SO_2$—; $R_4$ has the same meaning as $R_3$; and L and Z have the same meanings as in formula (2).

3. The silver halide photographic material of claim 1, wherein the moiety -Y-L-Z in formula (2) is represented by formula (4):

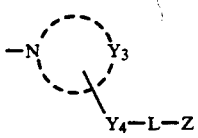

(4)

wherein L and Z have the same meanings as in formula (2); $Y_4$ is a single bond or is an aliphatic group, an aromatic group or a substituted divalent group formed by combining an aliphatic or aromatic group and —O—, —S—, -Se-,

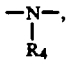

—CO—, —SO— or —$SO_2$—; $R_4$ is a hydrogen atom or has the same meaning as $R_1$ in formula (2); and $Y_3$ is a non-metallic atomic group that forms a nitrogen-containing hetero ring with the nitrogen atom in the formula (4).

4. The silver halide photographic material of claim 2, wherein the moiety L-Z in formula (3) is represented by formula (5):

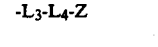

(5)

wherein $L_3$ is $$-\overset{O}{\overset{\|}{C}}O-,\ -S-\overset{O}{\overset{\|}{C}}-,\ -O-SO_2-,\ -O-SO_2\underset{\underset{R_5}{|}}{N}-\ \text{or}$$

$$-O-\underset{\underset{O}{\|}}{P}(OR_5)-;$$

$R_5$ is a hydrogen atom or has the same meaning as $R_1$ in formula (2); Z has the meaning as in formula (2); and $L_4$ is a single bond or has the same meaning as $Y_2$ in formula (3).

5. The silver halide photographic material of claim 2, wherein the moiety L-Z in formula (3) is represented by formula (6):

$$-L_5-\underset{\underset{L_6}{|}}{C}=\underset{\underset{L_6}{|}}{C}-L_7-L_4-Z \qquad (6)$$

wherein $L_5$ is $$-\overset{O}{\overset{\|}{C}}-$$

or $-SO_2-$; $L_6$ is a monovalent group, two $L_6$'s are the same or different, are bonded to each other to form a ring or one or both of the two $L_6$'s are bonded to Y of formula (2) to form a ring or a polycyclic ring; $L_7$ is —O—, —S— or $-SO_2-$; $L_4$ is a single bond or has the same meaning as $Y_2$ in formula (3); and Z has the same meaning as in formula (2).

6. The silver halide photographic material of claim 2 wherein the moiety L-Z in formula (3) is represented by formula (7):

$$-L_5-\underset{\underset{L_6}{|}}{CH}-\overset{\overset{L_6}{|}}{\underset{\underset{L_6}{|}}{C}}-L_7-L_4-Z \qquad (7)$$

wherein $L_4$ is a single bond or has the same meaning as $Y_2$ in formula (3), $L_5$ is $$-\overset{O}{\overset{\|}{C}}-$$

or $-SO_2-$, $L_6$ is a monovalent group, two $L_6$'s are the same or different, are bonded to each other to form a ring or one or both of the two $L_6$'s are bonded to Y of formula (2) to form a ring or a polycyclic ring, $L_7$ is —O—, —S— or $-SO_2-$ and Z has the same meaning as in formula (2).

7. The silver halide photographic material of claim 2, wherein the moiety L-Z in formula (3) is represented by formula (8):

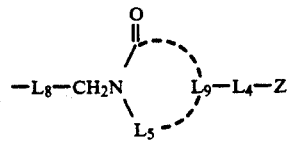

(8)

wherein $L_4$ is a single bond or has the same meaning as $Y_2$ in formula (3); Z has the same meaning as in formula (2); $L_5$ is $$-\overset{O}{\overset{\|}{C}}-$$

or $-SO_2-$; $L_8$ has the same meaning as $Y_1$ in formula (3); and $L_9$ is a non-metallic atomic group that forms a cyclic structure with the nitrogen atom, $L_5$ and carbonyl group.

8. The silver halide photographic material of claim 3, wherein the moiety L-Z in formula (4) is represented by formula (5):

$$-L_3-L_4-Z \qquad (5)$$

wherein $L_3$ is $$-\overset{O}{\overset{\|}{C}}O-,\ -S-\overset{O}{\overset{\|}{C}}-,\ -O-SO_2-,\ -O-SO_2\underset{\underset{R_5}{|}}{N}-\ \text{or}$$

$$-O-\underset{\underset{O}{\|}}{P}(OR_5)-;$$

$R_2$ is a hydrogen atom or has the same meaning as $R_1$ in formula (2); Z has the same meaning as in formula (2); and $L_4$ is a single bond or is an aliphatic group, an aromatic group or a substituted divalent group formed by combining an aliphatic or aromatic group and —O—, —S—, -Se-, $$-\underset{\underset{R_4}{|}}{N}-,$$

—CO—, SO— or $-SO_2-$; and $R_4$ is a hydrogen atom or has the same meaning as $R_1$ in formula (2).

9. The silver halide photographic material of claim 3, wherein the moiety L-Z in formula (4) is represented by formula (6):

$$-L_5-\underset{\underset{L_6}{|}}{C}=\underset{\underset{L_6}{|}}{C}-L_7-L_4-Z \qquad (6)$$

wherein $L_5$ is $$-\overset{O}{\overset{\|}{C}}-$$

or $-SO_2-$; $L_6$ is a monovalent group, two $L_6$'s are the same or different, are bonded to each other to form a ring or one or both of the two $L_6$'s are bonded to Y of formula (2) to form a ring or a polycyclic ring; $L_7$ is —O—, —S— or —SO—; $L_4$ is a single bond or is an aliphatic group, an aromatic group or a substituted divalent group formed by combining an aliphatic or aromatic group and —O—, —S—, -Se-,

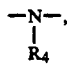

—CO—, —SO—]or —$SO_2$—; $R_4$ is a hydrogen atom or has the same meaning as $R_1$ in formula (2); and Z has the same meaning as in formula (2).

10. The silver halide photographic material of claim 3, wherein the moiety L-Z in formula (4) is represented by formula (7):

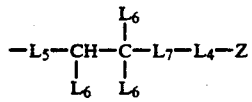

(7)

wherein $L_4$ is a single bond or is an aliphatic group, an aromatic group or a substituted divalent group formed by combining an aliphatic or aromatic group and —O—, —S—, -Se-,

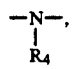

—CO—, —SO— or —$SO_2$—; $R_4$ is a hydrogen atom or as the same meaning as $R_1$ in formula (2), $L_5$ is

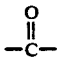

or —$SO_2$—, $L_6$ is a monovalent group, two $L_6$'s are the same or different, are bonded to each other to form a ring or one or both of the two $L_6$'s are bonded to Y of formula (2) to form a ring or a polycyclic ring, $L_7$ is —O—, —S— or —$SO_2$— and Z has the same meaning as in formula (2).

11. The silver halide photographic material of claim 3, wherein the moiety L-Z in formula (4) is represented by formula (8):

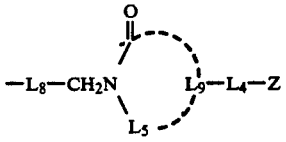

(8)

wherein $L_4$ is a single bond or is an aliphatic group, an aromatic group or a substituted divalent group formed by combining an aliphatic or aromatic group and —O—, —S—, -Se-,

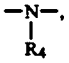

—CO—, —SO— or —$SO_2$—; $R_4$ is a hydrogen atom or has the same meaning as $R_1$ in formula (2); Z has the same meaning as in formula (2); $L_5$ is

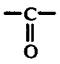

or —$SO_2$—; $L_8$ is —O—, —S—, -Se-, -Te- or

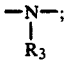

$R_3$ is a hydrogen atom or has the same meaning as $R_1$ in formula (2); and $L_9$ is a non-metallic atomic group that forms a cyclic structure with the nitrogen atom, $L_5$ and carbonyl group.

* * * * *